US012680696B2

(12) United States Patent
Bussman et al.

(10) Patent No.: US 12,680,696 B2
(45) Date of Patent: Jul. 14, 2026

(54) STAGED GAS INJECTION SYSTEM

(71) Applicant: John Zink Company, LLC, Tulsa, OK (US)

(72) Inventors: Wesley Ryan Bussman, Tulsa, OK (US); James Charles Franklin, Tulsa, OK (US); Dennis Lee Knott, Tulsa, OK (US); Jeff William White, Tulsa, OK (US)

(73) Assignee: John Zink Company, LLC

( * ) Notice: Subject to any disclaimer, the term of this patent is extended or adjusted under 35 U.S.C. 154(b) by 710 days.

(21) Appl. No.: 17/066,494

(22) Filed: Oct. 9, 2020

(65) Prior Publication Data

US 2021/0025589 A1 Jan. 28, 2021

Related U.S. Application Data

(63) Continuation-in-part of application No. 16/064,621, filed as application No. PCT/US2016/068510 on Dec. 23, 2016, now Pat. No. 10,837,636.

(60) Provisional application No. 62/343,362, filed on May 31, 2016, provisional application No. 62/343,342, filed on May 31, 2016, provisional application No. 62/387,147, filed on Dec. 23, 2015.

(51) Int. Cl.
*F23G 7/08* (2006.01)

(52) U.S. Cl.
CPC ..... *F23G 7/08* (2013.01); *F23G 2202/105* (2013.01); *F23G 2209/14* (2013.01)

(58) Field of Classification Search
CPC ..... F23G 7/08
See application file for complete search history.

(56) References Cited

U.S. PATENT DOCUMENTS

| | | | |
|---|---|---|---|
| 3,822,985 | A | 7/1974 | Straitz |
| 4,036,580 | A | 7/1977 | Reed |
| 4,087,235 | A | 5/1978 | Ito |
| 4,101,257 | A | 7/1978 | Straitz, III |
| 4,120,637 | A | 10/1978 | Reed |
| 4,227,872 | A | 10/1980 | Zink |

(Continued)

FOREIGN PATENT DOCUMENTS

| | | | |
|---|---|---|---|
| CN | 201209865 | Y | 3/2009 |
| GB | 1323674 | A | 7/1973 |

OTHER PUBLICATIONS

International Search Report and Written Opinion received for PCT Application No. PCT/IB2021/057760, mailed on Nov. 23, 2021, 14 Pages.

(Continued)

*Primary Examiner* — Jason Lau

(57) ABSTRACT

A staged gas injection system for a flare tip that can discharge waste gas into a combustion zone is provided. The staged gas injection system includes, for example, a first gas injection assembly and a second stage gas injection assembly. The first gas injection assembly is configured to inject a gas (for example steam or a gas other than steam) at a high flow rate and a high pressure into the flare tip or the combustion zone. The second gas injection assembly is configured to inject a gas (for example, steam and/or a gas other than steam) at a low flow rate and a high pressure into the flare tip or the combustion zone. A flare tip including the staged gas injection system is also provided.

22 Claims, 14 Drawing Sheets

(56) References Cited

U.S. PATENT DOCUMENTS

| | | | | |
|---|---|---|---|---|
| 4,492,558 | A | 1/1985 | Schwartz | |
| 4,652,232 | A | 3/1987 | Schwartz | |
| 5,707,596 | A | 1/1998 | Lewandowski | |
| 6,027,330 | A * | 2/2000 | Lifshits | F23C 9/08 431/115 |
| 6,383,462 | B1 * | 5/2002 | Lang | F23C 9/08 423/210 |
| 7,967,600 | B2 | 6/2011 | Hong | |
| 8,629,313 | B2 | 1/2014 | Hong | |
| 2006/0121399 | A1 | 6/2006 | Mashhour | |
| 2007/0292811 | A1 * | 12/2007 | Poe | F23M 5/025 431/278 |
| 2019/0024889 | A1 | 1/2019 | Bussman et al. | |

OTHER PUBLICATIONS

First Office Action and Search Report received for CN application No. 201680075219.5, mailed on Apr. 2, 2019, 36 pages. (22 pages of English translation and 14 pages of Official copy).

International Search Report & Written Opinion for Corresponding PCT application No. PCT/US2016/068510; 10 pages.

"Smokeless Operation", Retrieved from the Internet URL: https://saraswathula.tripod.com/FLARE/smokelessoperation.htm, pp. 1, 2014.

Tom Farmer, "Acceptable Operating Parameters for Steam Assisted Flares at Purge Rates", Retrieved from the Internet URL: https://f.hubspotusercontent10.net/hubfs/7724363/Zeeco-En_June_2020/pdf/AFRC-2011-Flare-Paper.pdf, 26 pages, 2011.

* cited by examiner

STAGED GAS INJECTION SYSTEM

CROSS-REFERENCE TO RELATED APPLICATIONS

This application is a continuation-in-part of U.S. Ser. No. 16/064,621 (filed on Jun. 21, 2018) and claims the benefit of PCT/US2016/068510 (filed on Dec. 23, 2016) and prior-filed U.S. provisional application Nos. 62/387,147 (filed on Dec. 23, 2015), 62/343,342 (filed on May 31, 2016), and 62/343,362 (filed on May 31, 2016), each of which is incorporated by reference herein.

BACKGROUND

Industrial flares for burning and disposing of combustible gases are well known. Such flares typically include one or more flare tips mounted on a flare stack. The flare tips initiate combustion of the gases and release the combustion products to the atmosphere. The flares are located at production, refining, processing plants, and the like. In many cases, more than one flare is included at a single facility.

For example, industrial flares are used for disposing of flammable gas, waste gas and other types of gas (collectively referred to as "waste gas") that need to be disposed. For example, industrial flares are used to safely combust flammable gas streams that are diverted and released due to system venting, plant shut-downs and upsets, and plant emergencies (including fires and power failures). A properly operating flare system can be a critical component to the prevention of plant disruption and damage.

It is desirable and often required for an industrial flare to operate in a relatively smokeless manner. For example, smokeless operation can usually be achieved by making sure that the waste gas is admixed with a sufficient amount of air in a relatively short period of time to sufficiently oxidize the soot particles formed in the flame. In applications where the gas pressure is low, the momentum of the waste gas stream alone may not be sufficient to provide smokeless operation. In such cases, an assist medium such as steam and/or air can be used to provide the necessary motive force to entrain ambient air from around the flare apparatus. Many factors, including local energy costs and availability, are taken into account in selecting a smoke suppressing assist medium.

The most common assist medium for adding momentum to low-pressure gases is steam. Steam is typically injected through one or more groups of nozzles that are associated with the flare tip. In addition to adding momentum and entraining air, steam can also dilute the gas and participate in the chemical reactions involved in the combustion process, both of which assist with smoke suppression. In one example of a simple steam assist system, several steam injectors extend from a steam manifold or ring that is mounted near the exit of the flare tip. The steam injectors direct jets of steam into the combustion zone adjacent the flare tip. One or more valves (which, for example, can be remotely controlled by an operator or automatically controlled based on changing operating parameters) are used to adjust the steam flow to the flare tip. The steam jets aspirate air from the surrounding atmosphere into the discharged waste gas with high levels of turbulence. This prevents wind from causing the flame to be pulled down from the combustion zone into and around the flare tip. Injected steam, educted air, and the waste gas combine to form a mixture that helps the waste gas burn without visible smoke.

A steam injection system for injecting steam into a waste gas stream entails control valves, piping to deliver the steam to the flare tip, steam injection nozzles, and distribution piping to deliver the steam to the steam injection nozzles. Some flares have multiple steam lines with multiple sets of steam injection nozzles for discharging steam into different locations associated with the flare tip.

Various issues can arise with steam injection systems. For example, steam injection systems use the momentum of the steam to entrain air and mix the air with the waste gas stream for smokeless combustion. At design flow rates, for example, steam discharges from the steam nozzles at sonic velocity (Mach=1 or greater). As the steam flow rate is decreased, the steam pressure at the steam nozzles decreases and eventually the flow rate is decreased low enough so that the steam discharge velocity is less than sonic. As the steam velocity decreases, the efficiency with which the steam entrains air and mixes it with the waste gas stream decreases. As an example, a flare tip at design flow rates may require 0.3 pounds of steam per pound of waste gas to generate smokeless combustion. At turndown conditions (e.g., lower steam injection pressure), the same flare tip and same waste gas stream (in terms of composition) can require 1.2 pounds or more of steam per pound of waste gas to achieve smokeless combustion. This can increase the operational cost of the flare.

Additionally, when a flare tip operates at low waste gas flow rates, it's possible for air and waste gas to mix within the flare tip. This is usually caused by the waste gas being less dense than the surrounding air and the wind driving air down into the flare tip. When air and waste gas mix, combustion can occur. When combustion occurs within the flare tip, the internal tubes of the flare tip can experience a rise in temperature. If the tubes get too hot, material degradation and deformation can occur, which can reduce the usable life of the flare tip.

In order to prevent such damage to the flare tip, manufacturers recommend continuously injecting steam into or around the flare tip (depending on the nature of the steam injection assembly) at a minimum flow rate, often referred to as a minimum steam rate. Continuous injection of steam at a minimum steam rate helps keep the temperature of the internal metal tubes and other equipment below the point at which rapid deterioration occurs. For example, the minimum steam rate causes a sufficient flow of steam and air through the internal tubes to transfer enough heat from the internal tubes to keep the temperatures of the tubes in acceptable ranges.

New regulations recently published by the United States government may alter the way operators control their flares. In the future, operators may have to account for not only the heating value of the waste gas as current regulations require, but also the amount of steam sent to the flare. This may cause issues when the flare is operating at turndown conditions. For example, operators may be required to enrich the waste gas with a supplemental gas (for example, natural gas) to maintain a net heating value in the combustion zone of 270 btu/scf or greater. Depending at least in part on the cost of the supplemental gas, such a requirement may cost operators anywhere from hundreds of thousands of dollars to millions of dollars a year per flare.

One way to reduce the amount of supplemental gas that may be needed is to reduce the minimum steam rate. However, a reduced minimum steam rate will likely reduce the service life of the flare, necessitating more frequent plant shutdowns and associated cost increases. A related problem that can occur is "water hammer." If a sufficient amount of steam is not provided to keep the steam lines warm and the steam lines cool off, the subsequent introduction of steam into the cold lines can cause problematic knocking or water hammer.

There are also situations in which a flare tip with multiple discharges is utilized with a waste gas that is lighter than air. When waste gas of this type is discharged at low waste gas flow rates, there is a possibility that the waste gas will preferentially flow through only a few of the internal tubular modules. If this occurs, air can flow down the internal tubular modules that do not receive waste gas. A fuel and air mixture can ensue which can ultimately flashback into the tip and cause a flame to stabilize within the flare tip. A flow of steam at a minimum steam rate can provide enough momentum to limit the amount of air that can flow into the flare tip and address this problem.

SUMMARY

By this disclosure, a staged gas injection system for a flare tip that can discharge waste gas into a combustion zone is provided. Also provided is a flare tip that can discharge waste gas into a combustion zone.

In one embodiment, the staged gas injection system provided by this disclosure is for a flare tip that can discharge waste gas into a combustion zone and includes an inner tubular member disposed within an outer tubular member. In this embodiment, the staged gas injection system comprises a first gas injection assembly and a second gas injection assembly. The first gas injection assembly is configured to inject a gas at a high flow rate and a high pressure into the inner tubular member of the flare tip, and includes a first stage gas source and a first gas injection nozzle fluidly connected to the first stage gas source. The first stage gas source can be a source of steam and/or alternative gas. The second gas injection assembly is configured to inject a gas at a low flow rate and a high pressure into the inner tubular member of the flare tip, and includes a second stage gas source and a second gas injection nozzle fluidly connected to the second stage gas source. The first gas injection assembly and second gas injection assembly are proximate to each other and oriented in the same direction such that both the first gas injection assembly and the second gas injection assembly inject gas into the inner tubular member of the flare tip.

In another embodiment, the staged gas injection system provided by this disclosure is for a flare tip that can discharge waste gas into a combustion zone. In this embodiment, the staged gas injection system comprises a first gas injection assembly and a second gas injection assembly. The first gas injection assembly is configured to inject gas at a high flow rate and a high pressure into the combustion zone, and includes a first stage gas source and a first gas injection nozzle fluidly connected to the first stage gas source. The first stage gas source is a source of steam and/or an alternative gas. The second gas injection assembly is configured to inject a gas at a low flow rate and a high pressure into the combustion zone, and includes a second stage gas source and a second gas injection nozzle fluidly connected to the second stage gas source. The first gas injection assembly and second gas injection assembly are proximate to each other and oriented in the same direction such that both the first gas injection assembly and the second gas injection assembly inject gas into the combustion zone.

In one embodiment, the flare tip provided by this disclosure can discharge waste gas into a combustion zone and includes an inner tubular member disposed within an outer tubular member and a staged gas injection system. In this embodiment of the flare tip, the staged gas injection system comprises a first gas injection assembly and a second gas injection assembly. The first gas injection assembly is configured to inject gas at a high flow rate and a high pressure into the inner tubular member of the flare tip, and includes a first stage gas source and a first gas injection nozzle fluidly connected to the first stage gas source. The first stage gas source is a source of steam and/or an alternative gas. The second gas injection assembly is configured to inject a gas at a low flow rate and a high pressure into the inner tubular member of the flare tip, and includes a second stage gas source and a second gas injection nozzle fluidly connected to the second stage gas source. The first gas injection assembly and second gas injection assembly are proximate to each other and oriented in the same direction such that both the first gas injection assembly and the second gas injection assembly inject gas into the inner tubular member of the flare tip.

In another embodiment, the flare tip provided by this disclosure can discharge waste gas into a combustion zone and includes a staged gas injection system. In this embodiment of the flare tip, the staged gas injection system comprises a first gas injection assembly and a second gas injection assembly. The first gas injection assembly is configured to inject gas at a high flow rate and a high pressure into the combustion zone, and includes a first stage gas source and a first gas injection nozzle fluidly connected to the first stage gas source. The first stage gas source is a source of steam and/or an alternative. The second gas injection assembly is configured to inject a gas at a low flow rate and a high pressure into the combustion zone, and includes a second stage gas source and a second gas injection nozzle fluidly connected to the second stage gas source. The first gas injection assembly and second gas injection assembly are proximate to each other and oriented in the same direction such that both the first gas injection assembly and the second gas injection assembly inject gas into the combustion zone.

BRIEF DESCRIPTION OF THE DRAWINGS

The drawings included with this application illustrate certain aspects of the embodiments described herein. However, the drawings should not be viewed as exclusive embodiments. The subject matter disclosed is capable of considerable modifications, alterations, combinations, and equivalents in form and function, as will occur to those skilled in the art with the benefit of this disclosure.

FIG. 9 is a sectional view of an embodiment of a three-stage gas injection system disclosed herein.

FIG. 13 is a graph comparing a plot of the normalized steam/hydrocarbon ratio (lb/lb) to the normalized flare fuel rate (lb/hr) corresponding to a high flow rate, high pressure steam nozzle to a plot of the normalized steam/hydrocarbon ratio (lb/lb) to the normalized flare fuel rate (lb/hr) corresponding to a low flow rate, high pressure steam nozzle.

DETAILED DESCRIPTION

Figure 1A:
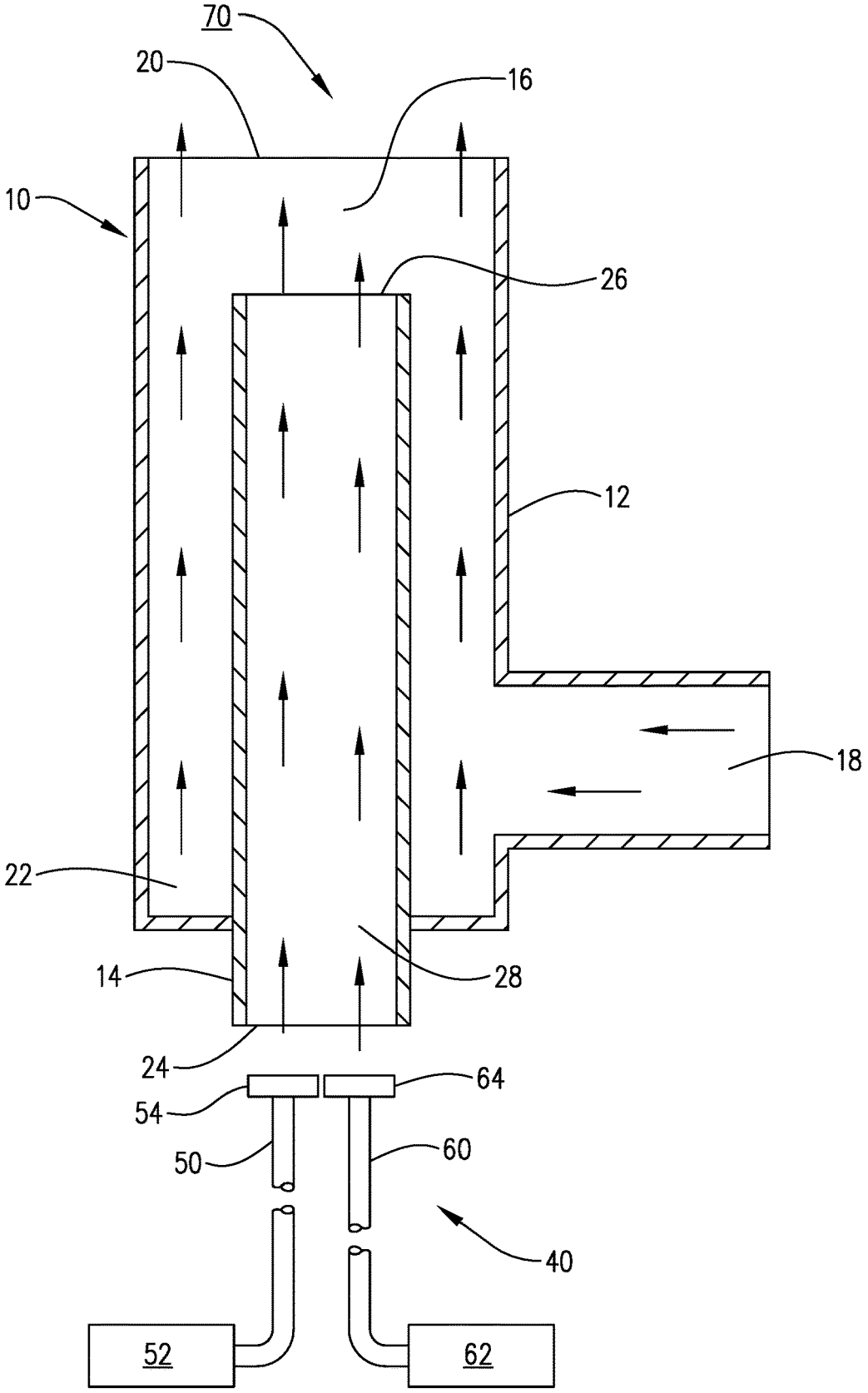
FIG. 1A is a sectional view of the one embodiment of the staged gas injection system disclosed herein.
Figure 1:
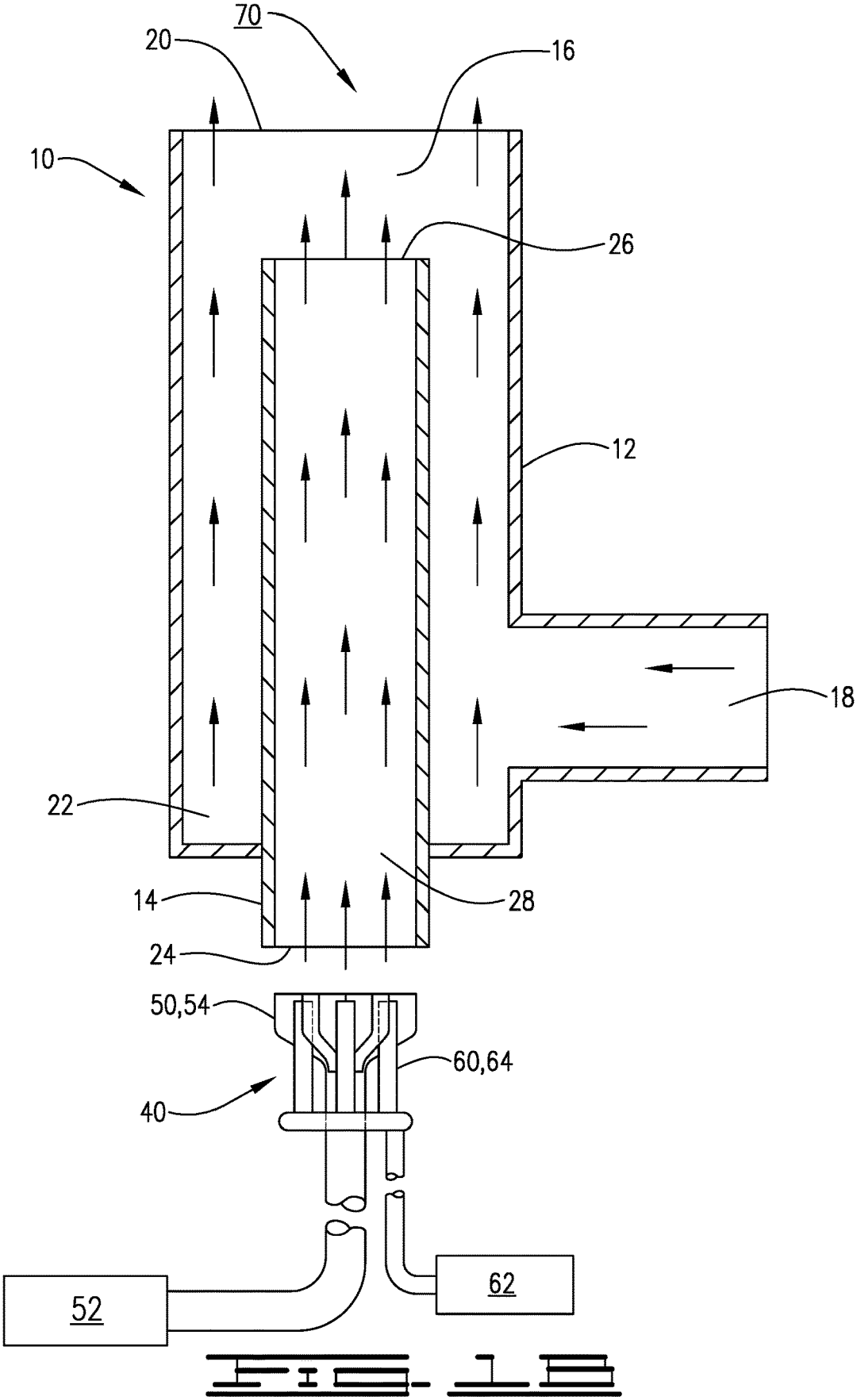
FIG. 1B is a sectional view of another embodiment of the staged gas injection system disclosed herein.

The present disclosure may be understood more readily by reference to this detailed description. For simplicity and clarity of illustration, where appropriate, reference numerals may be repeated among the different figures to indicate corresponding or analogous elements. In addition, numerous specific details are set forth in order to provide a thorough understanding of the various embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

By this disclosure, a staged gas injection system and a flare tip including the staged gas injection system are provided.

It has been discovered that the above issues can be addressed by providing a staged gas injection system that has the ability to discharge steam, an alternative gas, or steam and an alternative gas to the flare apparatus at various stages (that is, at various flow rates and pressures). For example, the staged gas injection system disclosed herein can be a two-stage system that includes two gas injection nozzles, one for injecting steam and/or an alternative gas into the flare tip at a high flow rate and high pressure (for example, as in a traditional, standard steam injection system), and one for injecting steam and/or an alternative gas into the flare tip at the same location at a low flow rate and high pressure. As another example, the staged gas injection system can be a three-stage system that includes three gas injection nozzles, one for injecting steam and/or an alternative gas into the flare tip at a high flow rate and a high pressure (for example, as in a traditional, standard steam injection system), one for injecting steam and/or an alternative gas into the flare tip at the same location at a lower flow rate and a high pressure, and one for injecting steam and/or an alternative gas into the flare tip at the same location at an even lower flow rate and at a high pressure. The number of stages that can be used is not limited. For example, four or five gas injection nozzles, each having the ability to discharge steam and/or an alternative gas to the flare apparatus at a different flow rate and pressure, can also be used. The number of stages that should be used in a given application is dependent, for example, on the type of flare apparatus, the location of the staged gas injection system with respect to the flare tip and other factors known to those skilled in the art with the benefit of this disclosure.

The staged gas injection system of the present disclosure allows a gas-assisted flare to operate with less steam and/or other assist gases at reduced waste gas flow rates. For example, the staged gas injection system disclosed herein provides the momentum necessary to efficiently entrain and mix air with the waste gas at turndown conditions. Additionally, when steam is used as at least one of the staged gases, such a system provides the ability to maintain temperatures at acceptable levels within the steam lines. The system uses less steam at turndown conditions without impacting the service life of the flare tip.

As used herein and in the appended claims, "waste gas" means waste gas, flammable gas, plant gas, and any other type of gas that can be disposed of by an industrial flare. An alternative gas means a gas other than steam. Examples of alternative gases that can be used include air, nitrogen, plant gas, natural gas and mixtures thereof. As described above, an alternative gas can be discharged by the staged gas injection system through one or more of the gas injection nozzles that inject gas into the flare tip at a relatively low flow rate (as compared to the relatively high flow rate associated with, for example, a traditional standard steam injection system). Whether an alternative gas is used and the specific alternative gas (or gases) used will depend, for example, on the desired flame profile and properties. When the same type of gas is used in connection with more than one gas injection nozzle, the corresponding gas sources can be the same. For example, in a two-stage system in which each stage uses only steam, the first stage gas source and second stage gas source can be the same gas source, namely, a source of steam.

Figure 5:
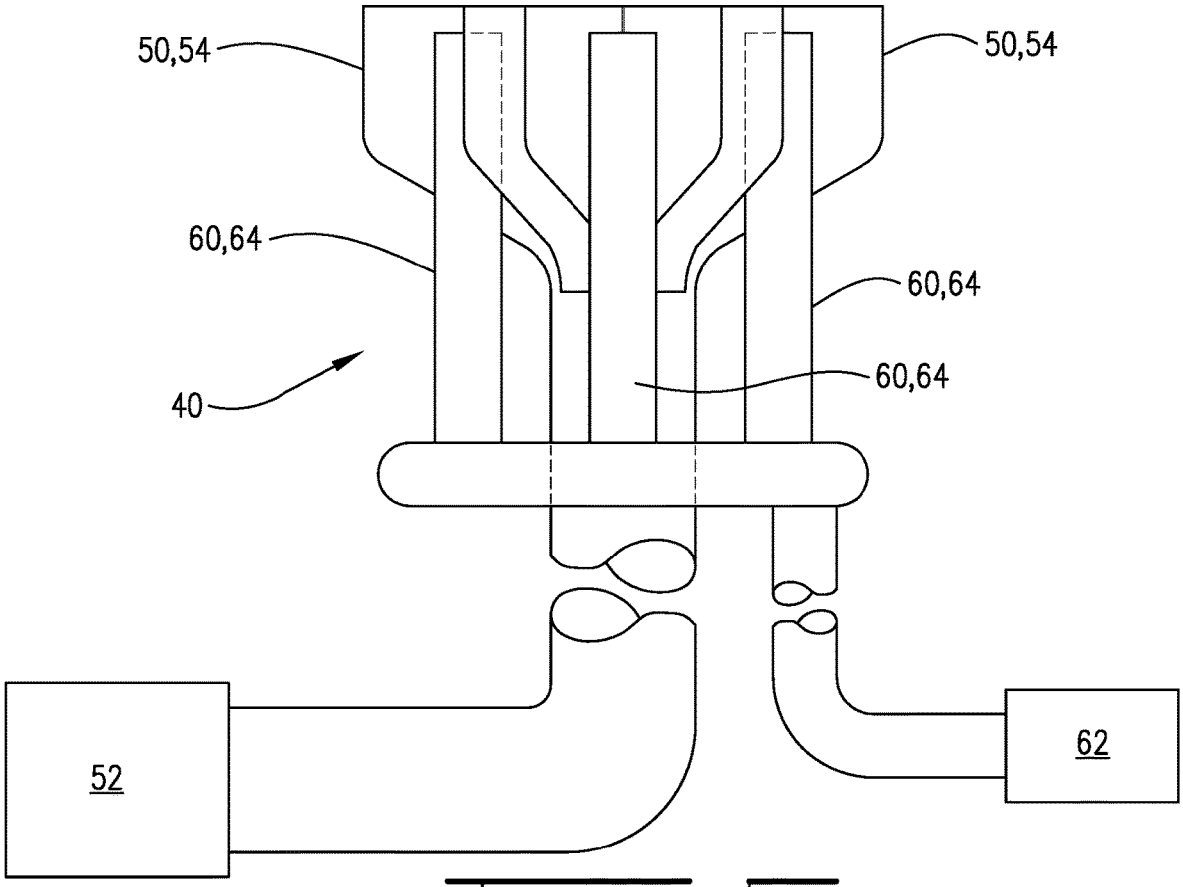
FIG. 5 is a side view of an embodiment of the staged gas injection system disclosed herein.
Figure 6:
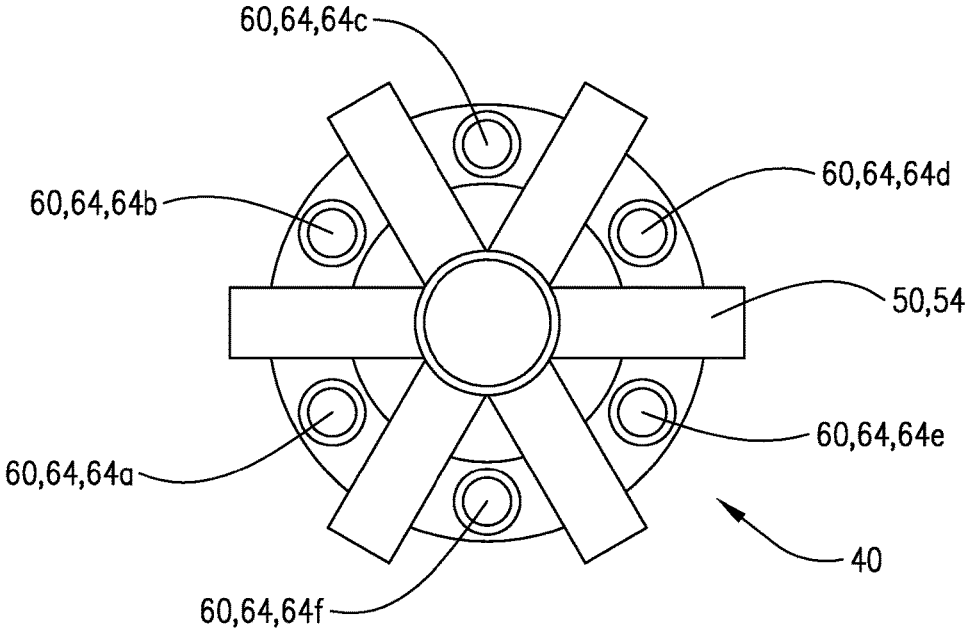
FIG. 6 is a top view of the embodiment of the staged gas injection system shown by FIG. 5.
Figure 7:
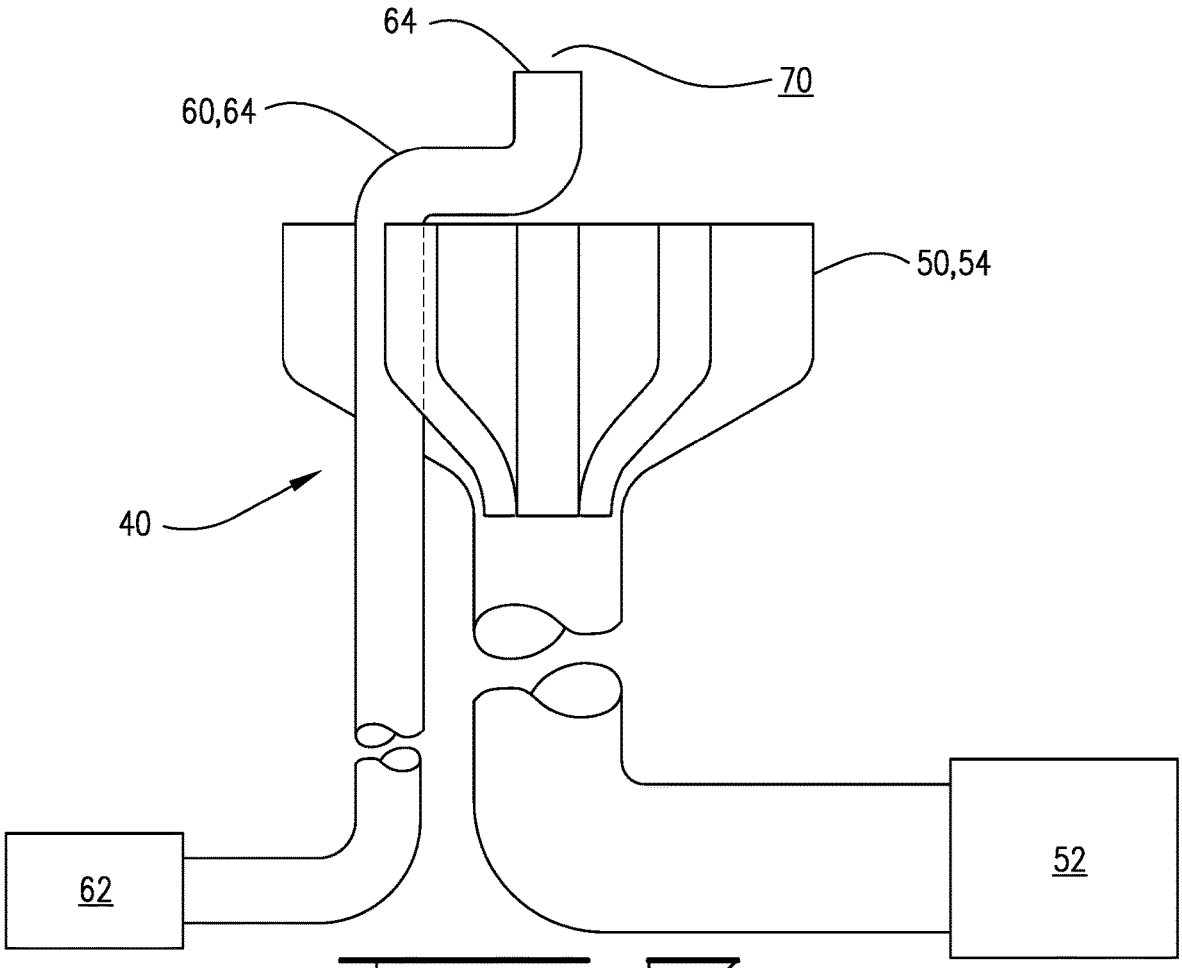
FIG. 7 is a side view of one embodiment of a gas injection nozzle disclosed herein.
Figure 8:
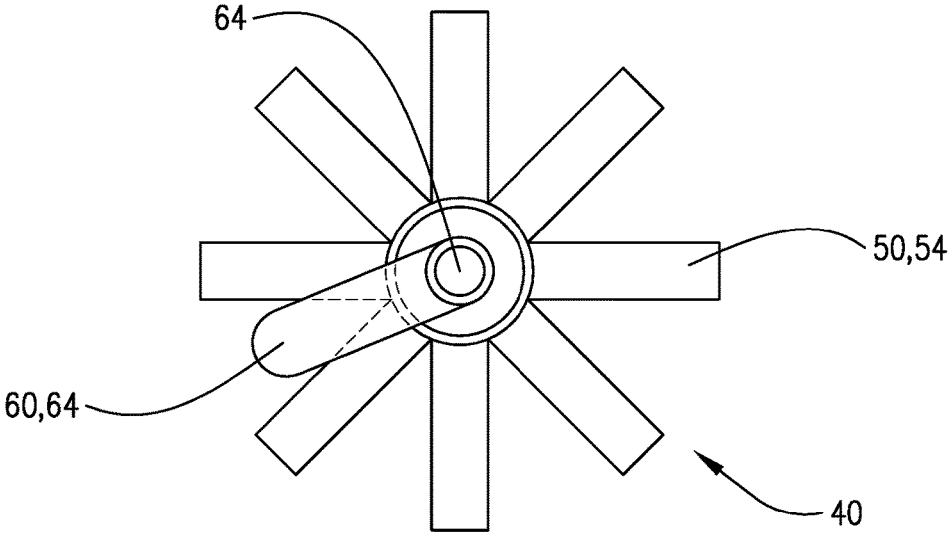
FIG. 8 is a top view of the gas injection nozzle shown by FIG. 7.
Figure 8:
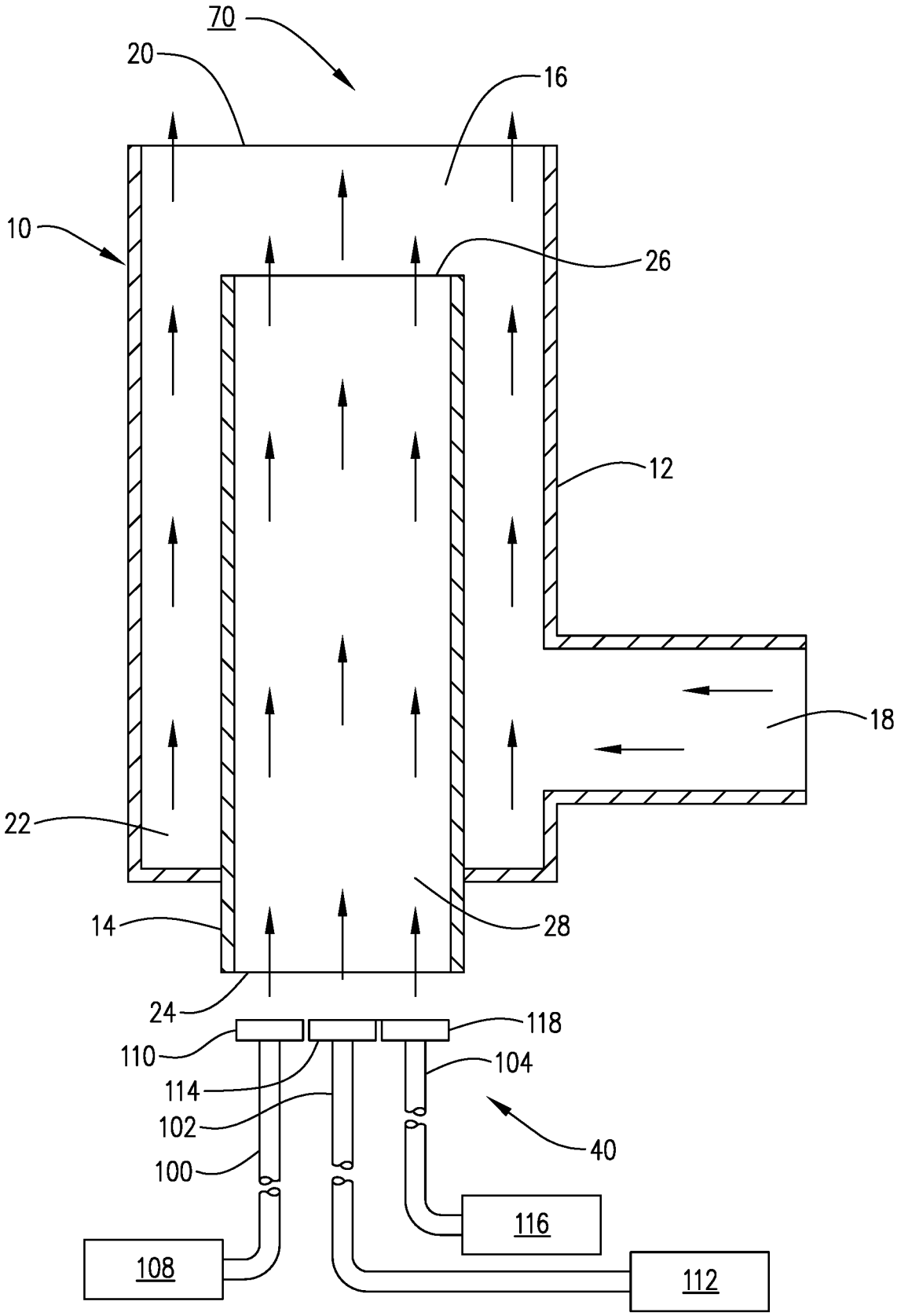
Figure 10:
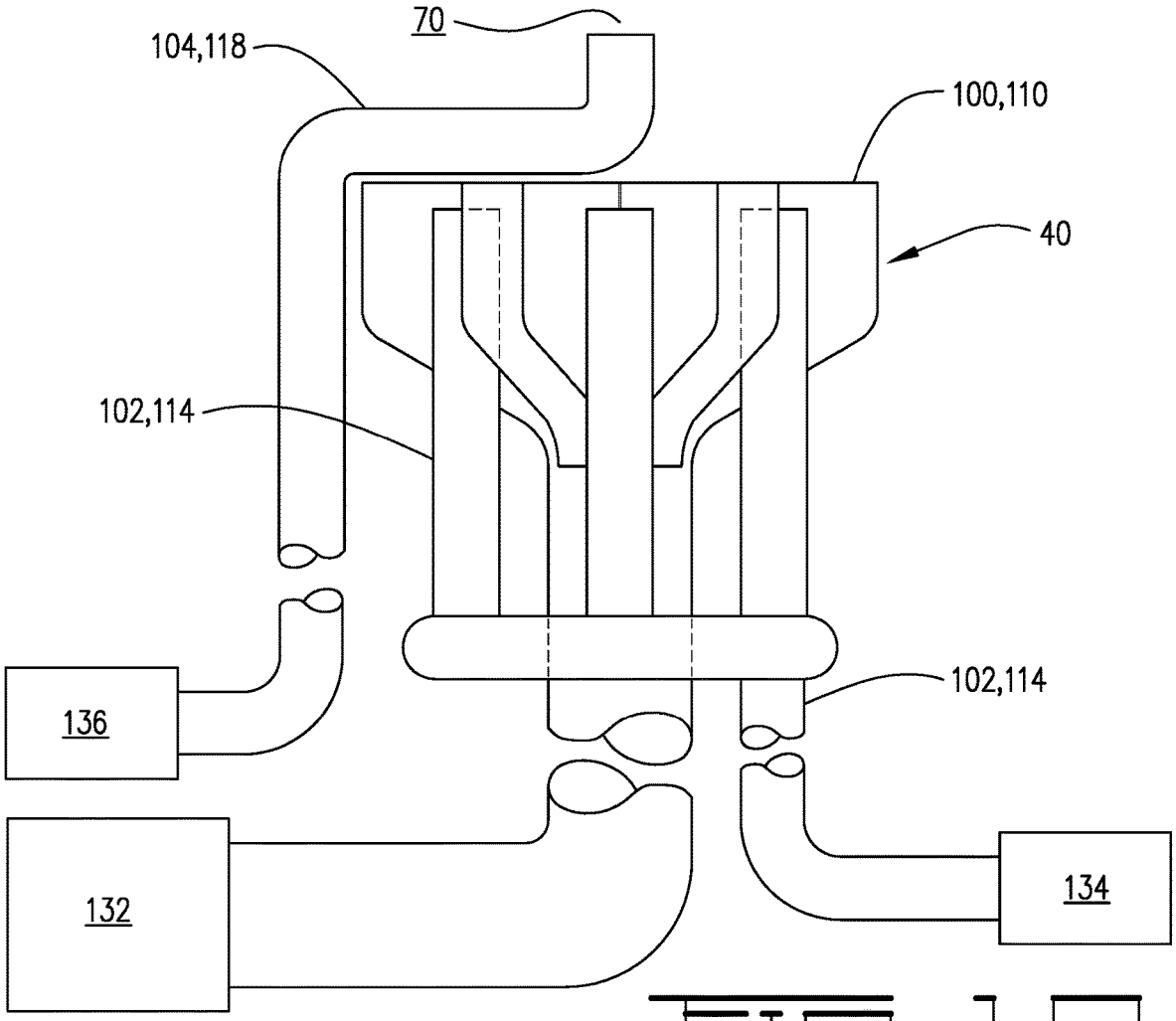
FIG. 10 is a side view of another embodiment of a three-stage gas injection system disclosed herein.
Figure 11:
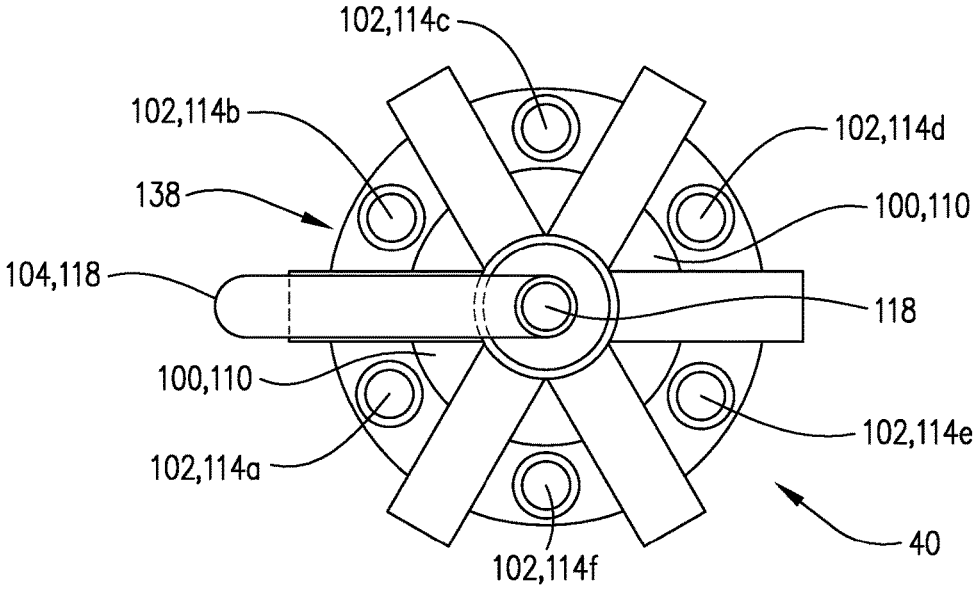
FIG. 11 is a top view of the gas injection assembly illustrated by FIG. 10.
Figure 12:
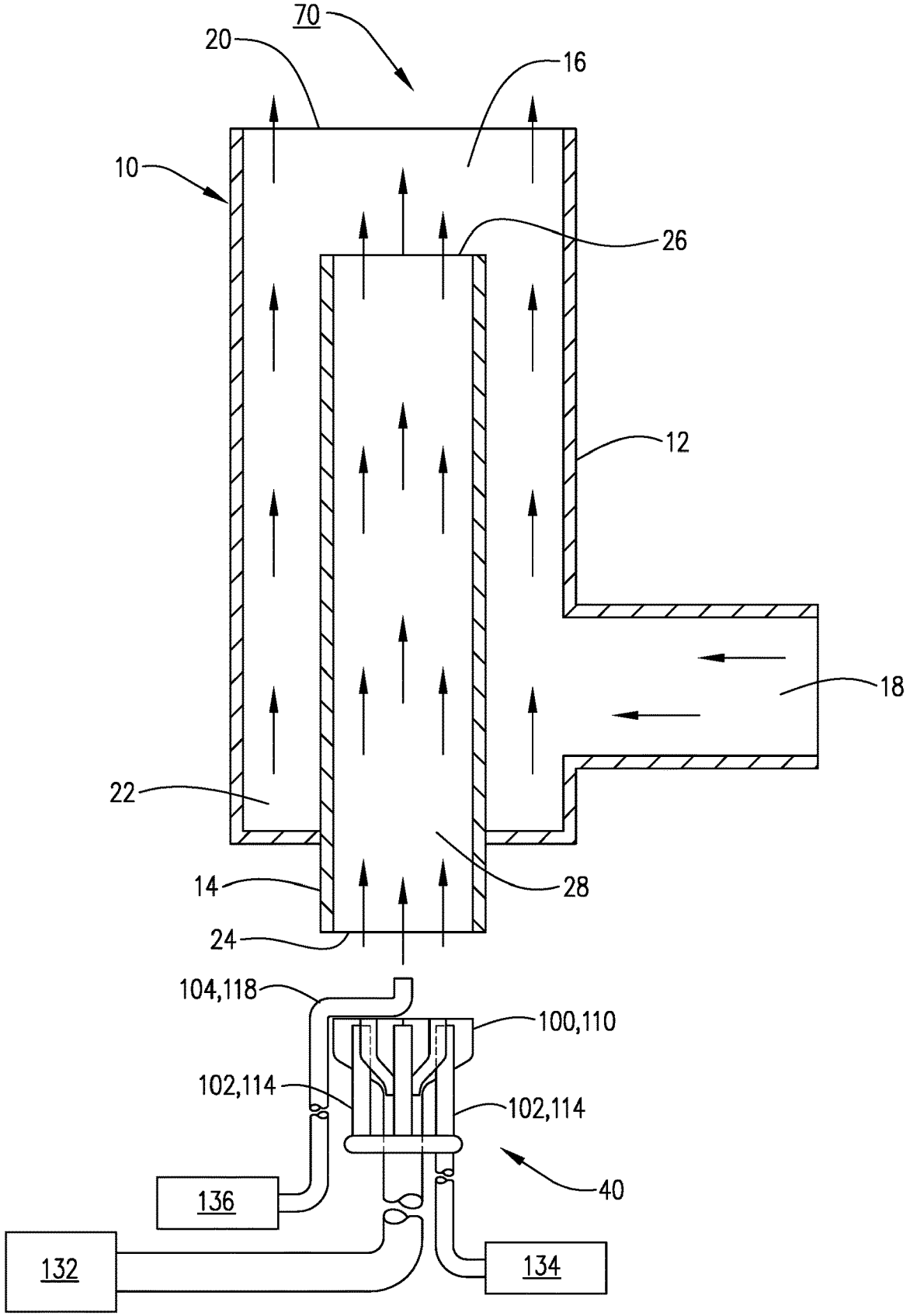
FIG. 12 is a sectional view illustrating the staged gas injection assembly shown by FIGS. 10 and 11 as directed to an inner tubular member of a single flare tip.
Figure 15:
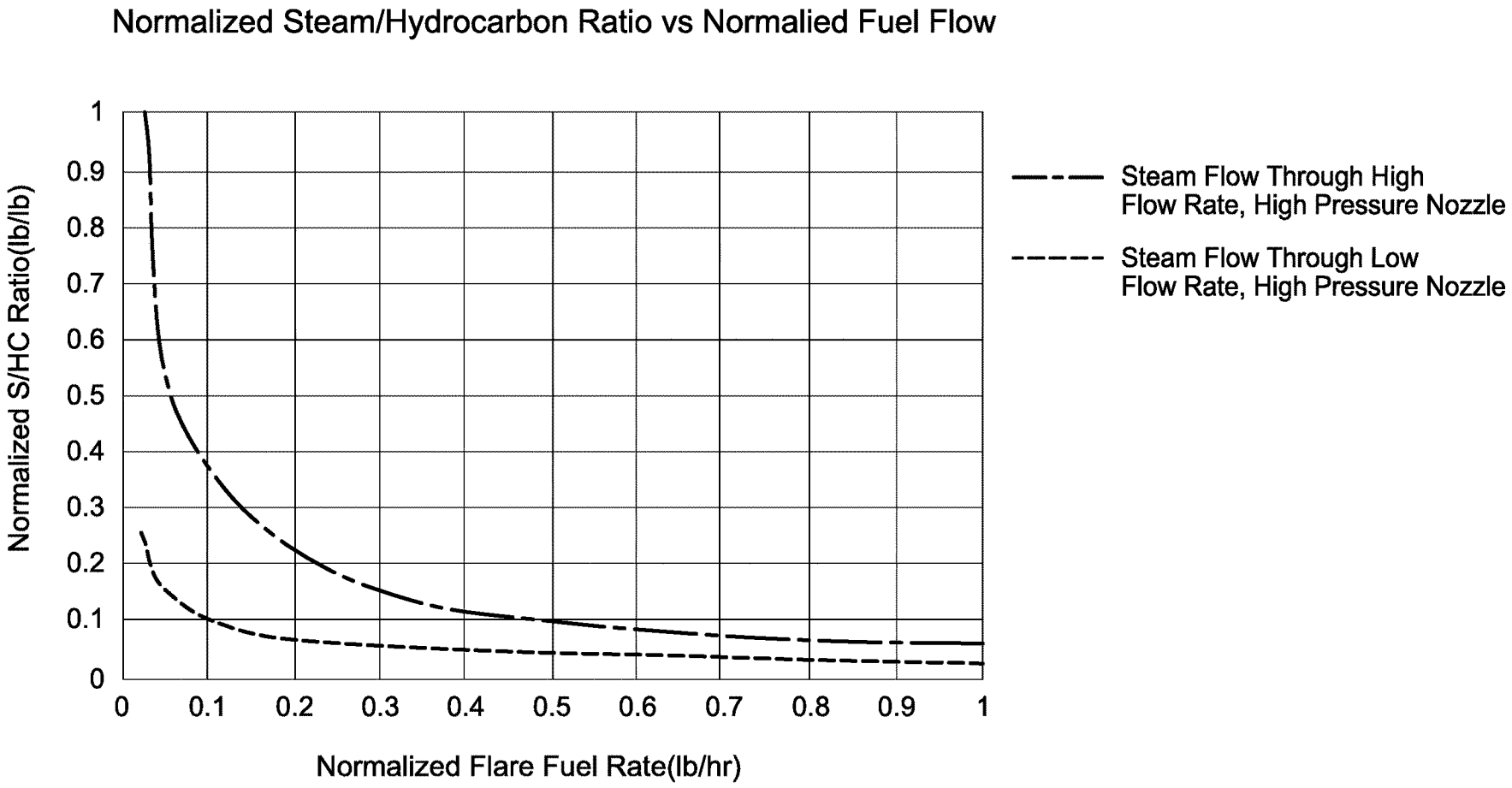

Referring now to the drawings, the staged gas injection system disclosed herein, generally designated by the reference numeral 40, will be described. For example, FIGS. 1A, 2A, 3A, and 4A show an embodiment of the staged gas injection system 40 that includes two separate gas injection assemblies, as used in conjunction with four different flare tip configurations. FIGS. 1B, 2B, 3B, and 4B show an embodiment of the staged gas injection system 40 that includes two separate gas injection assemblies that are combined in part into a single unit, as used in conjunction with the same four different flare tip configurations shown by FIGS. 1A, 2A and 4A. FIGS. 5 and 6 illustrate the two-stage gas injection assembly shown by FIGS. 1B, 2B, 3B and 4B in more detail. FIGS. 7 and 8 illustrate another embodiment of a two-stage gas injection assembly that can be used herein. FIG. 9 shows an embodiment of the staged gas injection system 40 that includes three separate gas injection assemblies, as used in conjunction with the flare tip configuration shown by FIGS. 1A and 1B. FIGS. 10 and 11 illustrate an embodiment of the staged gas injection system 40 in which three separate gas injection assemblies are combined in part into a single unit. FIG. 12 shows the three-stage gas injection assembly illustrated by FIGS. 10 and 11, as used in conjunction with the flare tip configuration shown by FIGS. 1A and 1B. FIG. 13 illustrates results achieved by testing the staged gas injection system disclosed herein.

As used herein and the appended claims, injection of steam and/or alternative gas at a "high flow rate and a high pressure" means that on a per nozzle basis, the steam is injected from the corresponding gas injection nozzles at a flow rate (flow capacity) of at least 2000 lb/hr, and at a pressure of at least 50 psig. As used herein and in the appended claims, injection of steam and/or an alternative gas at a "low flow rate and a high pressure" means that on a per nozzle basis, the steam and/or alternative gas is injected from the corresponding gas injection nozzles at a flow rate (flow capacity) of one-half or less of the flow rate (flow capacity) at which the steam and/or other gas is injected from the corresponding gas injection nozzles used at the next larger stage, and at a pressure of at least 50 psig. For example, in a two-stage system, injection of steam and/or an alternative gas at a "low flow rate and a high pressure" in the second stage means that on a per nozzle basis the steam and/or alternative gas is injected from the corresponding gas injection nozzles at a flow rate (flow capacity) of one-half or less of the corresponding high flow/high pressure nozzle flow rate (flow capacity), and at a pressure of at least 50 psig. For example, in a three-stage system, injection of steam and/or an alternative gas at a "low flow rate and a high pressure" in the third stage means that on a per nozzle basis the steam and/or alternative gas is injected from the corresponding gas injection nozzles at a flow rate (flow capacity) of one-half or less of the nozzle flow rate (flow capacity) used in the second stage, and at a pressure of at least 50 psig. For example, the decrease in the nozzle flow rate (flow capacity) in the second stage and subsequent stages (if used) to one-half or less of the nozzle flow rate (flow capacity) used in the next larger stage can be accomplished by using nozzles that each contain one or more discharge ports having a total discharge area of one-half or less of the total discharge area of the discharge port(s) of each nozzle used in the next larger stage.

The pressures at which the steam and/or other gas is injected from the gas injection nozzles used in the various stages can also vary from stage to stage. For example, the pressures utilized can vary from 5 psig to 300 psig, including 60, 90, 100, 120, 150, 180, 210, 240, and 270 psig. Suitable pressure ranges can include 5 psig to 200 psig, 5 psig to 100 psig, 20 psig to 300 psig, 20 psig to 200 psig, 20 psig to 100 psig, 40 psig to 300 psig, 40 psig to 200 psig, 40 psig to 100 psig, 60 psig to 300 psig, 60 psig to 200 psig, and 60 psig to 100 psig. The gas injection assemblies and corresponding nozzles can utilize the available steam at the production, refining, or processing plant where the flare assembly is installed.

The staged gas injection system 40 is used in connection with a flare assembly (not shown in full). The flare assembly includes a flare riser (not shown) for conducting a waste gas stream to a flare tip 10. The flare tip 10 is attached to the flare riser and configured to discharge a waste gas stream into a combustion zone 70 in the atmosphere adjacent the flare tip.

For example, in the configuration shown by FIGS. 1A, 1B, 9 and 12, the flare tip 10 includes an outer tubular member 12, inner tubular member 14, and a pre-mix zone 16. The outer tubular member 12 includes an inlet 18, an outlet 20, and a gas passage 22. The inner tubular member 14 includes an inlet 24, an outlet 26, and a gas passage 28. The inner tubular member 14 is coaxially disposed in the outer tubular member 12. For example, waste gas is conducted through the inlet 18 of the outer tubular member 12 into the gas passage 22, into the pre-mix zone 16 and through the outlet 20 of the outer tubular member into the combustion zone 70. The pre-mix zone 16 is located between the outlet 26 of the inner tubular member 14 and the outlet 20 of the outer tubular member 12. In the pre-mix zone 16, steam and/or an alternative gas discharged through the outlet 26 of the inner tubular member 14 are mixed with waste gas and discharged through the outlet 20 of the outer tubular member 12 into the combustion zone 70 therewith. The discharge of the waste gas mixture from the pre-mix zone 16 into the combustion zone 70 entrains additional air into the waste gas. As understood by those skilled in the art with the benefit of this disclosure, a pilot assembly (not shown) can also be associated with the flare tip 10 to ignite the waste gas/air mixture in the combustion zone 70.

Figure 2A:
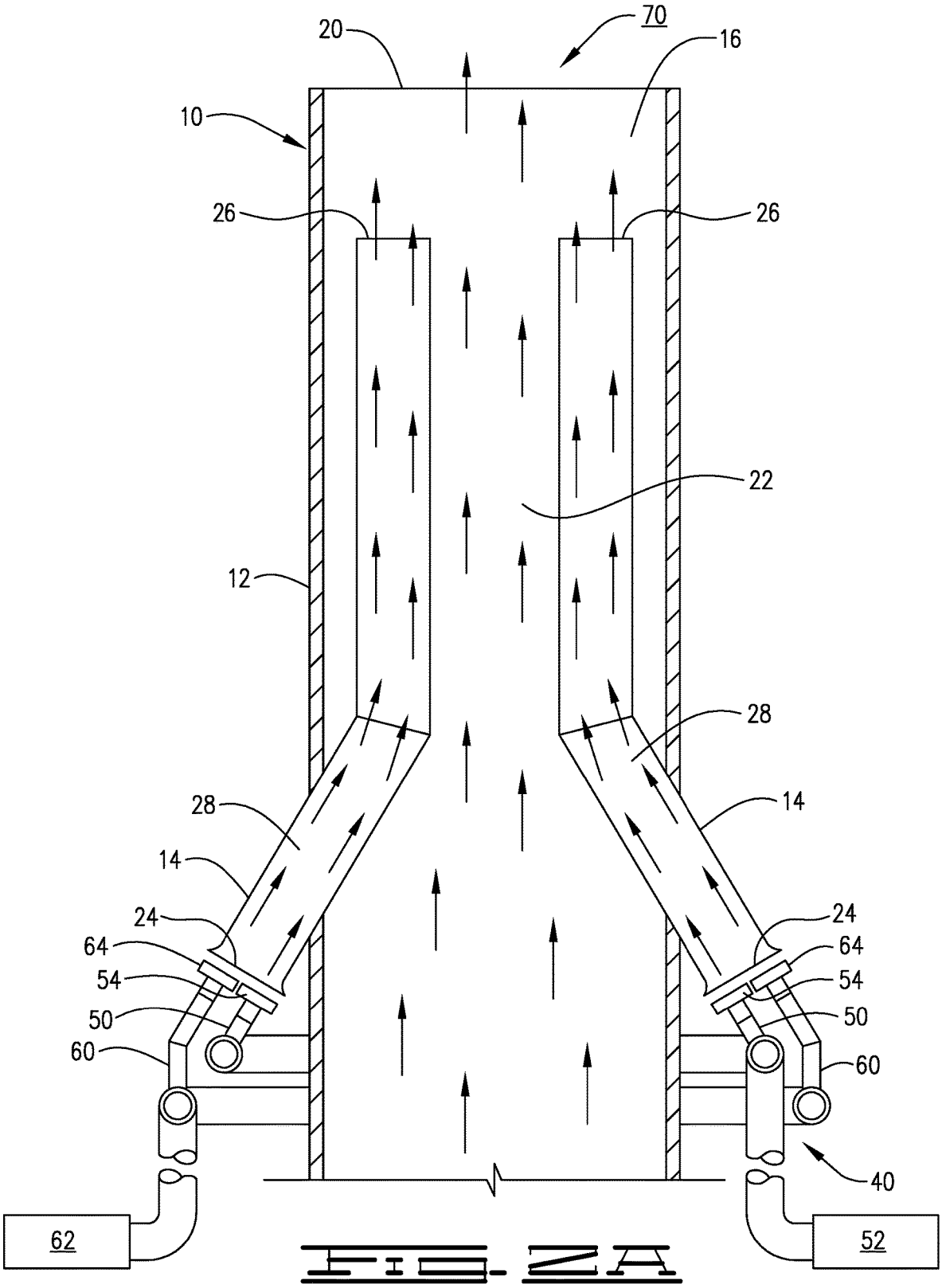
FIG. 2A is a sectional view showing the staged gas injection system shown by FIG. 1A in a different flare configuration.
Figure 2B:
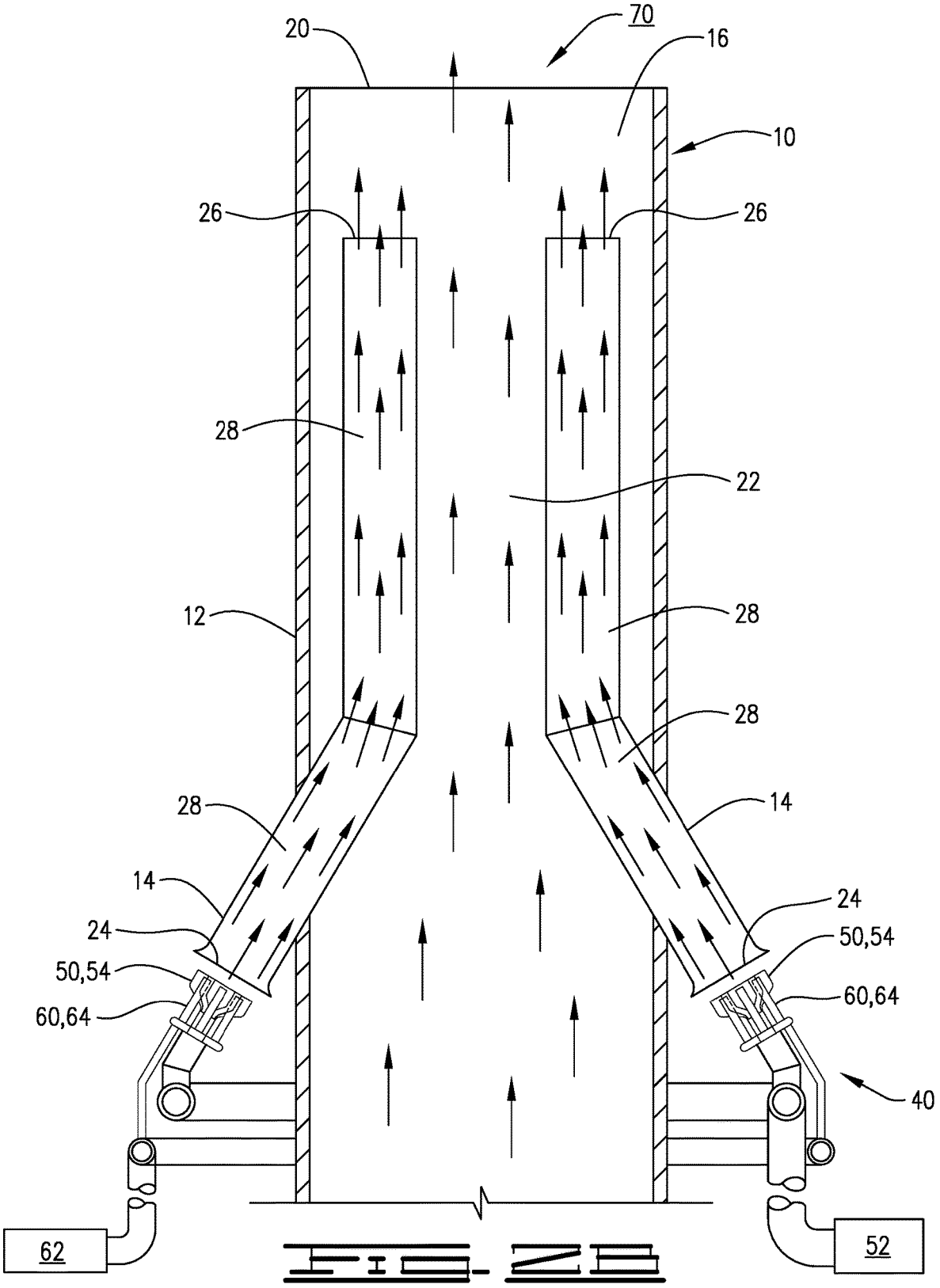
FIG. 2B is a sectional view showing the staged gas injection system shown by FIG. 1B in a different flare configuration.

For example, in the configuration shown by FIGS. 2A and 2B, the flare tip 10 includes an outer tubular member 12, two inner tubular members 14, and a pre-mix zone 16. The outer tubular member 12 includes an inlet (not shown), an outlet 20, and a gas passage 22. The inner tubular members 14 each include an inlet 24, an outlet 26, and a gas passage 28. The inner tubular members 14 are disposed in the outer tubular member 12. For example, although two inner tubular members 14 are shown by FIGS. 2A and 2B, more than 2 (for example, 4 or 6) inner tubular members 14 can be positioned in the outer tubular member 12. For example, waste gas is conducted through the inlet of the outer tubular member 12 (not shown) into the gas passage 22, into the pre-mix zone 16 and through the outlet 20 of the outer tubular member into the combustion zone 70. The pre-mix zone 16 is located between the outlets 26 of the inner tubular members 14 and the outlet 20 of the outer tubular member 12. In the pre-mix zone 16, steam and/or an alternative gas discharged through the outlets 26 of the inner tubular members 14 are mixed with waste gas and discharged through the outlet 20 of the outer tubular member 12 into the combustion zone 70 therewith. The discharge of the waste gas mixture from the pre-mix zone 16 into the combustion zone 70 entrains additional air into the waste gas. As understood by those skilled in the art with the benefit of this disclosure, a pilot assembly (not shown) can also be associated with the flare tip 10 to ignite the waste gas/air mixture in the combustion zone 70.

Figure 3A:
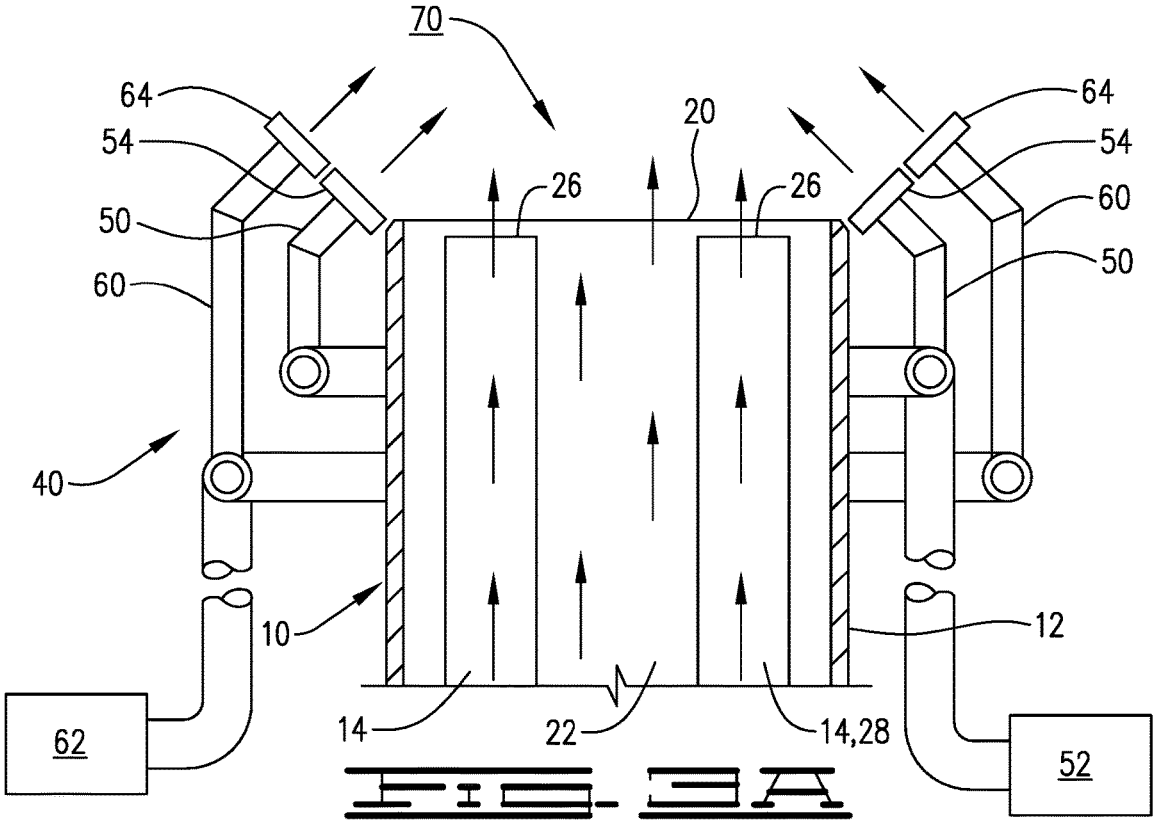
FIG. 3A is a sectional view of an additional embodiment of the staged gas injection system shown by FIG. 1A.
Figure 3B:
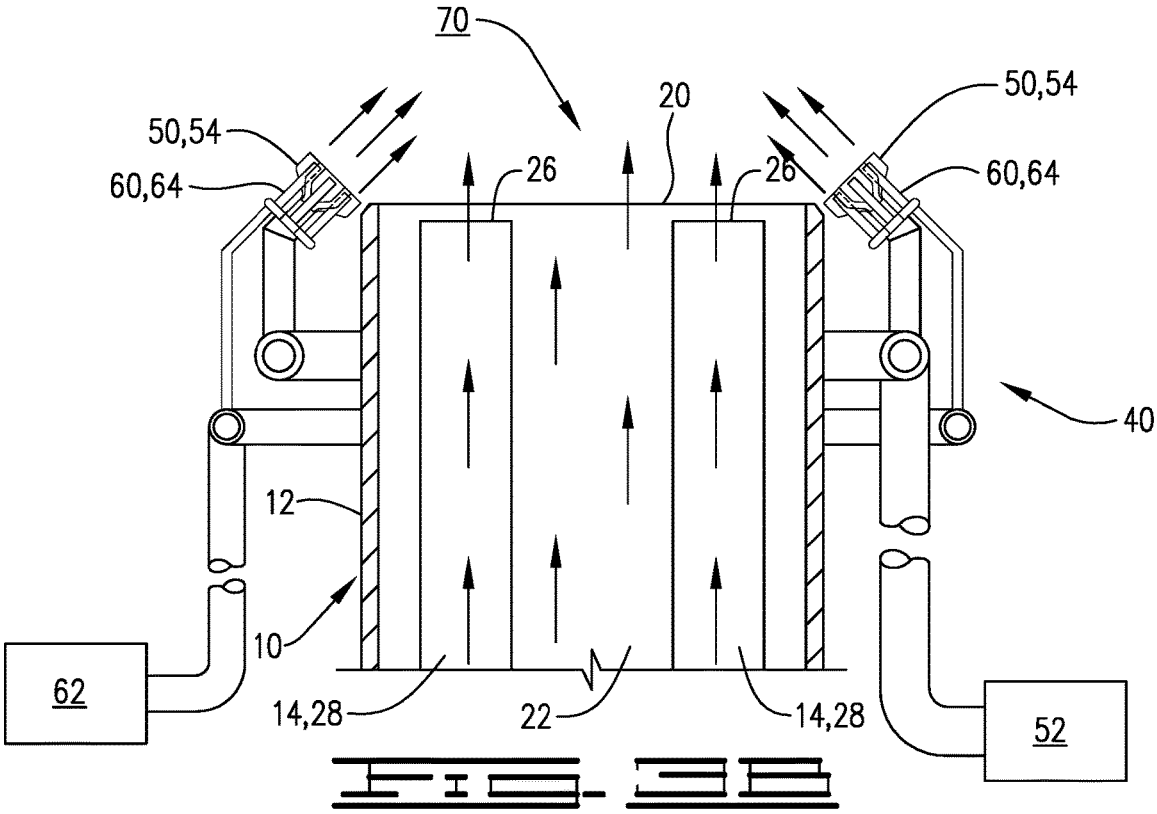
FIG. 3B is a sectional view of an additional embodiment of the staged gas injection system shown by FIG. 1B.

For example, in the configuration shown by FIGS. 3A and 3B, the flare tip 10 includes an outer tubular member 12 and two inner tubular members 14. The outer tubular member 12 includes an inlet (not shown), an outlet 20, and a gas passage 22. The inner tubular members 14 each include inlets (not shown), an outlet 26, and a gas passage 28. The inner tubular members 14 are disposed in the outer tubular member 12. For example, although two inner tubular members 14 are shown by FIGS. 3A and 3B, more than 2 (for example, 4 or 6) inner tubular members 14 can be positioned in the outer tubular member 12. For example, waste gas is conducted through the inlet of the outer tubular member 12 into the gas passage 22, and through the outlet 20 of the outer tubular member into the combustion zone 70. A stage gas (steam and/or an alternative gas) is conducted through the inner tubular members 14, through the outlets 26 thereof and into the combustion zone 70. The discharge of the waste gas and stage gas mixture into the combustion zone 70 entrains additional air into the waste gas. As understood by those skilled in the art with the benefit of this disclosure, a pilot assembly (not shown) can also be associated with the flare tip 10 to ignite the waste gas/air mixture in the combustion zone 70.

Figure 4A:
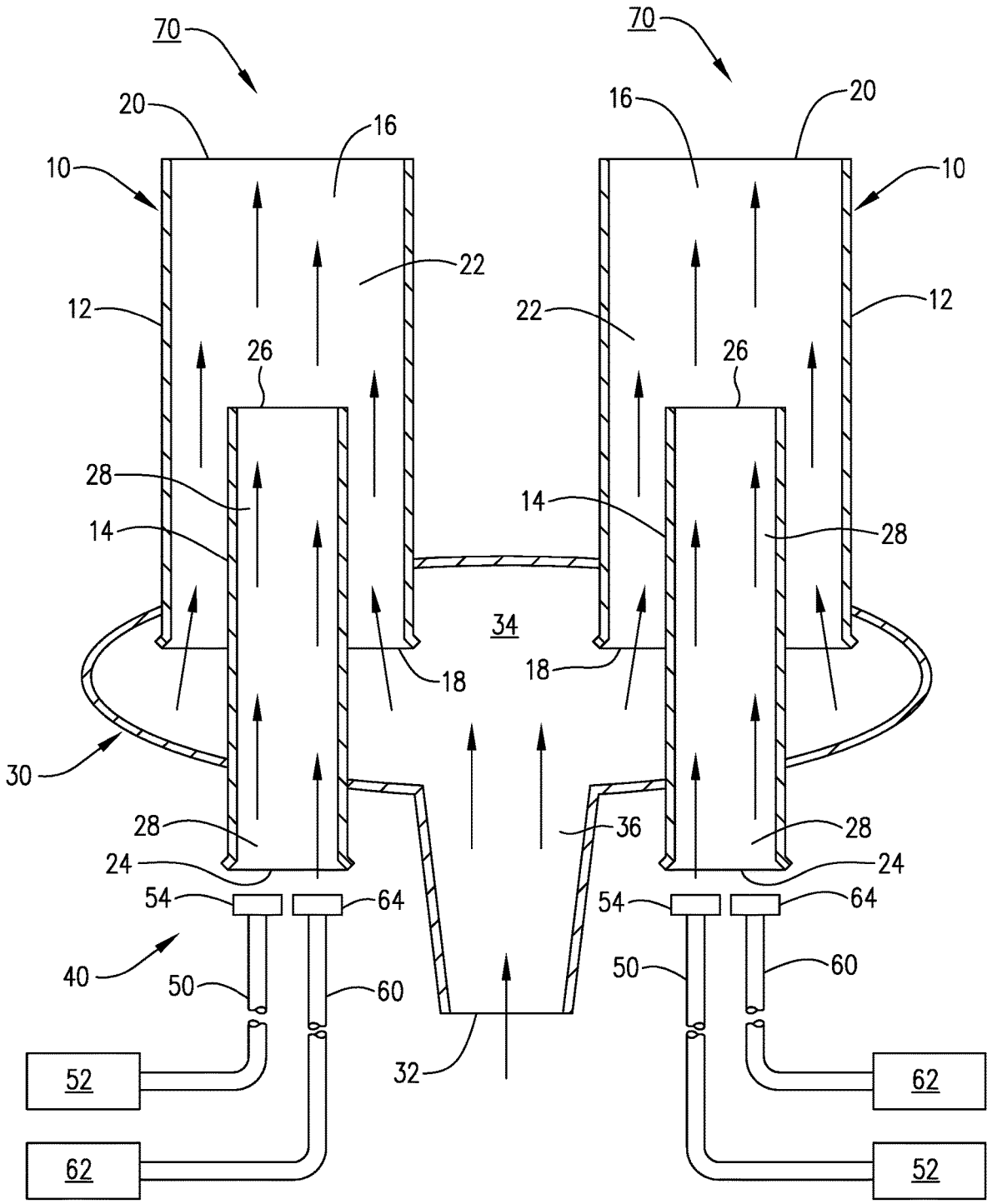
FIG. 4A is a sectional view of an additional embodiment of the staged gas injection system shown by FIG. 1A.
Figure 4B:
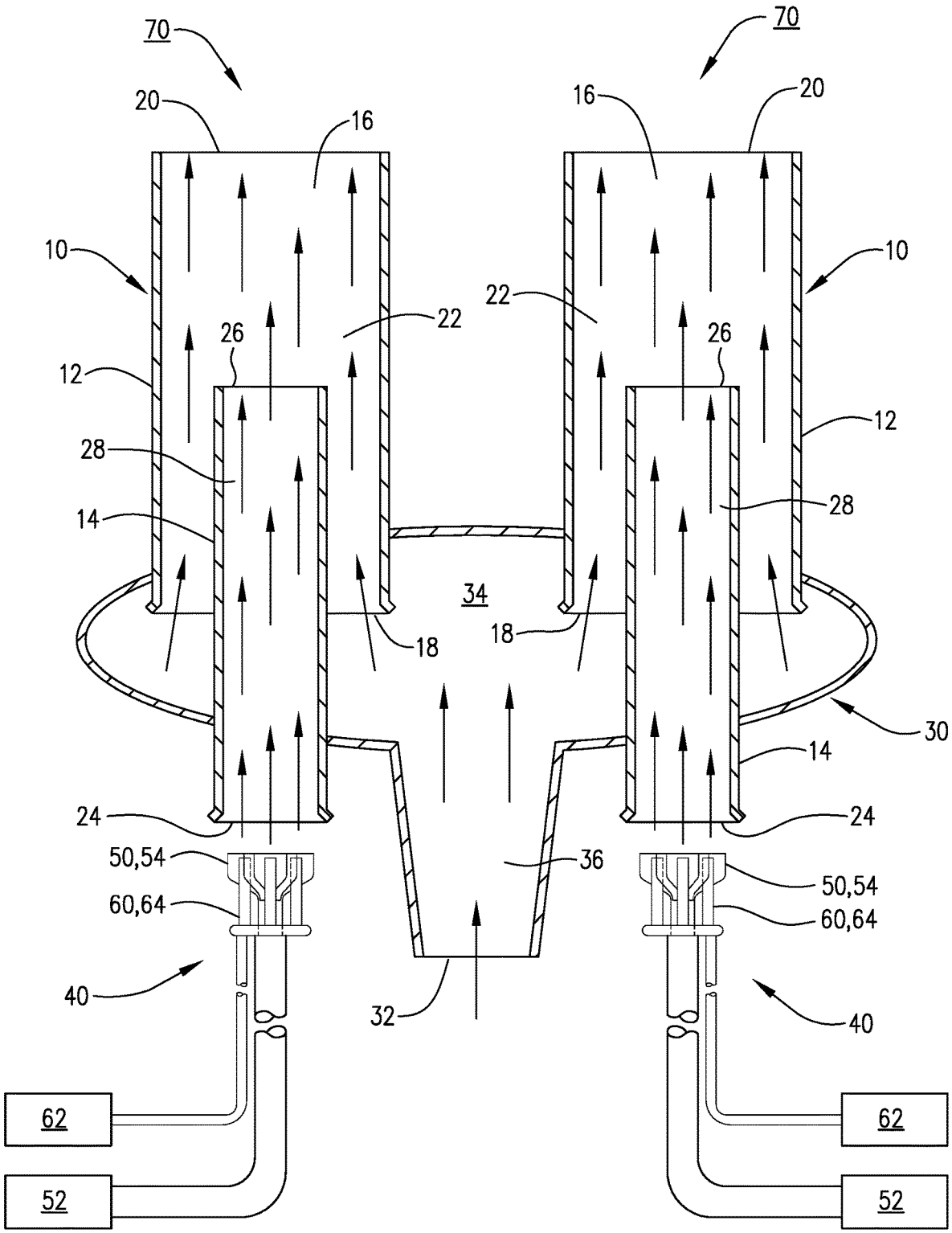
FIG. 4B is a sectional view of an additional embodiment of the staged gas injection system shown by FIG. 1B.

For example, in the configuration shown by FIGS. 4A and 4B, the flare tip 10 includes two outer tubular members 12, two inner tubular members 14, and two pre-mix zones 16. The outer tubular members 12 each include an inlet 18, an outlet 20, and a gas passage 22. The inner tubular members 14 each include an inlet 24, an outlet 26, and a gas passage 28. The inner tubular members 14 are disposed in the outer tubular member 12. A waste gas manifold 30 having an inlet 32, an outlet 34 and a gas passage 36 surrounds the outer tubular members 12. For example, waste gas is conducted through the inlet 32 into the gas passage 36 of the waste gas manifold 30, through the outlet 34 of the waste gas manifold into the inlets 18 of the outer tubular members 12, into the gas passages 22, into the pre-mix zones 16 and through the outlets 20 of the outer tubular member into the combustion zone(s) 70 (in this flare tip configuration, two separate combustion zones can be created). The pre-mix zones 16 are located between the outlets 26 of the inner tubular members 14 and the outlets 20 of the outer tubular members 12. In the pre-mix zones 16, steam and/or an alternative gas discharged through the outlets 26 of the inner tubular members 14 are mixed with waste gas and discharged through the outlets 20 of the outer tubular members 12 into the combustion zone(s) 70 therewith. The discharge of the waste gas mixture from the pre-mix zones 16 into the combustion zone(s) 70 entrains additional air into the waste gas. As understood by those skilled in the art with the benefit of this disclosure, one or more pilot assemblies (not shown) can also be associated with the flare tip 10 to ignite the waste gas/air mixture in the combustion zone(s) 70.

Referring now specifically to FIGS. 1A, 2A, 3A, and 4A, one embodiment of the staged gas injection system 40 disclosed herein will be described in more detail. In FIGS. 2A, 3A and 4A, two staged gas injection systems 40 (each of this embodiment) are used. In this embodiment, the staged gas injection system 40 includes a first gas injection assembly 50 and a second gas injection assembly 60 that are proximate to each other and oriented in the same direction such that both gas injection assemblies inject steam and/or an alternative gas into the flare tip 10 (as shown by FIGS. 1A, 2A and 4A) or combustion zone 70 (as shown by FIG. 3A). As used herein and in the appended claims, the statement that the first gas injection assembly 50 and second gas injection assembly 60 are proximate to each other and oriented in the same direction such that both gas injection assemblies inject steam (and/or an alternative gas in the case of assembly 60) into the flare tip 10 or combustion zone 70 means that at least part of each gas injection assembly (for example, the gas injection nozzles) are proximate to each other and oriented in the same direction such that both gas injection assemblies inject steam and/or an alternative gas into the flare tip 10 or combustion zone 70. For example, the gas sources of the assemblies are not necessarily oriented in the same direction.

The first gas injection assembly 50 is configured to inject steam and/or an alternative gas at a high flow rate and a high pressure into the flare tip 10 (as shown by FIGS. 1A, 2A and 4A) or combustion zone 70 (as shown by FIG. 3A). The first gas injection assembly 50 includes a first stage gas source 52 and a gas injection nozzle 54 fluidly connected to the first stage gas source. The first stage gas source 52 is a source of steam and/or an alternative gas, and provides such first stage gas to the gas injection nozzle 54.

The second gas injection assembly 60 is configured to inject a gas (steam and/or an alternative gas) at a low flow rate and a high pressure into the flare tip 10 (as shown by FIGS. 1A, 2A and 4A) or combustion zone 70 (as shown by FIG. 3A). The second gas injection assembly 60 includes a second stage gas source 62 and a second gas injection nozzle 64 fluidly connected to the second stage gas source. The second stage gas source 62 provides steam and/or an alternative gas to the second gas injection nozzle 64. The second gas injection nozzle 64 includes at least one discharge port that has a total discharge area of no greater than one-half of the corresponding total discharge area of the discharge port(s) of the high flow rate, high pressure gas injection nozzle 54. This allows the second gas injection assembly 60 to inject gas at a low flow rate and high pressure.

As shown by FIGS. 1A, 2A and 4A, the first gas injection assembly 50 is configured to inject a first stage gas (steam and/or an alternative gas) at a high flow rate and a high pressure into the inner tubular member(s) 14 of the flare tip 10. The second gas injection assembly 60 is configured to inject a second stage gas (steam and/or an alternative gas) at a low flow rate and a high pressure into the inner tubular member(s) 14 of the flare tip 10. Injection of the first stage gas by the first gas injection assembly 50 and the second stage gas by the second gas injection assembly 60 into the inner tubular member(s) 14 aspirates air from the surrounding environment into the pre-mix zone(s) 16 of the flare tip 10 and into the waste gas conducted by the gas passage(s) 22 to the pre-mix zone(s).

As shown by FIG. 3A, the first gas injection assembly 50 is configured to inject a first stage gas (steam and/or an alternative gas) at a high flow rate and a high pressure into the combustion zone 70. The second gas injection assembly 60 is configured to inject a second stage gas (steam and/or an alternative gas) at a low flow rate and a high pressure into the combustion zone 70. Injection of the first stage gas by the first gas injection assembly 50 and the second stage gas by the second gas injection assembly 60 into the combustion zone 70 aspirates air from the surrounding environment which is mixed with the waste gas.

Referring now to FIGS. 1B, 2B, 3B, 4B, 5, and 6, another embodiment of the staged gas injection system 40 disclosed herein will be described. In FIGS. 2B, 3B and 4B, two staged gas injection systems 40 (each of this embodiment) are used.

The embodiment of the staged gas injection system 40 shown by FIGS. 1B, 2B, 3B, 4B, 5, and 6 is the same in all respects as the embodiment of the staged gas injection 40 shown by FIGS. 1A, 2A, 3A and 4A, except the first gas injection assembly 50 and second gas injection assembly 60 are combined, in part, to form a single unit. The partial combination of the gas injection assemblies into a single unit improves the distribution of stage gas by the system 40. For example, the gas injection nozzle(s) 54 and gas injection nozzle(s) 64 are combined together into a single unit. The first gas injection assembly 50 and second gas injection assembly 60 are still proximate to each other and oriented in the same direction such that both gas injection assemblies inject steam (and/or an alternative gas in the case of assembly 60) into the flare tip 10 (as shown by FIGS. 1B, 2B and 4B) or combustion zone 70 (as shown by FIG. 3B). The first gas injection assembly 50 is still configured to inject a first stage gas (steam and/or an alternative gas) at a high flow rate and a high pressure into the flare tip 10 (as shown by FIGS. 1B, 2B, and 4B) or combustion zone 70 (as shown by FIG. 3B). The second gas injection assembly 60 is still configured to inject a second stage gas (steam and/or an alternative gas) at a low flow rate and a high pressure into the flare tip 10 (as shown by FIGS. 1B, 2B and 4B) or combustion zone 70 (as shown by FIG. 3B). The second gas injection nozzle(s) 64 still includes at least one discharge port that has a total discharge area of no greater than one-half of the corresponding total discharge area of the discharge port(s) of the high flow rate, high pressure gas injection nozzle 54.

As best shown by FIG. 6, the second gas injection nozzle 64 includes a plurality of discharge ports 64*a*, 64*b*, 64*c*, 64*d*, 64*e* and 64*f*. The gas injection nozzle 64 can include more than 6 or less than 6 discharge ports as desired. For example, from 6 to 24 discharge ports can be used. As with the other embodiments of the staged gas injection system 40, the discharge of stage gas steam and/or an alternative gas) aspirates air from the surrounding atmosphere which is mixed with the waste gas and helps promote smokeless combustion.

Referring now to FIGS. 7 and 8, another embodiment of the staged gas injection system 40 will be described. This embodiment is the same in all respects as the embodiment of the staged gas injection system 40 shown by FIGS. 1B, 2B, 3B and 4B, except for the configuration of the second gas injection nozzle 64. In this embodiment, as shown by FIGS. 7 and 8, the discharge area of the second gas injection nozzle 64 is positioned above the vertical center axis of the first gas injection nozzle 54. Alternatively, the discharge area of the second gas injection nozzle 64 can be flush with or positioned below the first gas injection nozzle 54. For example, the embodiment of the staged gas injection system 40 shown by FIGS. 7 and 8 can be substituted for the embodiment of the staged gas injection system 40 shown by FIGS. 1B, 2B, 3B, 4B, 5 and 6.

FIG. 9 illustrates another embodiment of the staged gas injection system 40 as used in connection with the flare assembly and flare tip 10 shown by FIG. 1A. In this embodiment, the staged gas injection system 40 is a three-stage gas injection system that includes a first gas injection assembly 100, a second gas injection assembly 102, and a third gas injection assembly 104. The first gas injection assembly 100, second gas injection assembly 102, and third gas injection assembly 104 are all proximate to each other and oriented in the same direction such that all three gas injection assemblies inject stage gas (steam and/or an alternative gas) into the inner tubular member 14 of the flare tip 10.

The first gas injection assembly 100 is configured to inject a first stage gas (steam and/or an alternative gas) at a high flow rate and a high pressure into the inner tubular member 14 of the flare tip 10 of the flare assembly. The first gas injection assembly 100 includes a first stage gas source 108 fluidly connected to a first gas injection nozzle 110. The first stage gas source 108 provides the first stage gas to the first gas injection nozzle 110. The first gas injection nozzle 110 discharges first stage gas into the inner tubular member 14 and in doing so aspirates air from the surrounding atmosphere into the pre-mix zone 16.

The second gas injection assembly 102 is configured to inject a second stage gas (steam and/or an alternative gas) at a low flow rate and a high pressure into the inner tubular member 14. The second gas injection assembly 102 includes a second stage gas source 112 that is fluidly connected to a second gas injection nozzle 114. The second stage gas source 112 provides second stage gas to the second gas injection nozzle 114. The second gas injection nozzle 114 includes at least one discharge port that has a total discharge area of no greater than one-half of the corresponding total discharge area of the discharge port(s) of the high flow rate, high pressure first gas injection nozzle 110. This allows the second gas injection assembly 102 to inject gas at a low flow rate and high pressure.

The third gas injection assembly 104 is configured to inject a third stage gas (steam and/or an alternative gas) at a low flow rate and a high pressure into the inner tubular member 14 of the flare tip 10 of the flare assembly. The third gas injection assembly 104 includes a third stage gas source 116 that is fluidly connected to a third gas injection nozzle 118. The third stage gas source 116 provides the third stage gas to the third gas injection nozzle 118. The third gas injection nozzle 118 includes at least one discharge port that has a total discharge area of no greater than one-half of the corresponding total discharge area of the discharge port(s) of the second gas injection nozzle 114. This allows the third gas injection assembly 104 to inject gas at an even lower flow rate and at high pressure. As with the other embodiments of the staged gas injection system 40, the discharge of stage gas (steam and/or an alternative gas) aspirates air from the surrounding atmosphere which is mixed with the waste gas and promotes smokeless combustion.

Referring now to FIGS. 10 and 11, another embodiment of the staged gas injection system 40 will be described. This embodiment of the staged gas injection system 40 is the same in all respects as the embodiment of the staged gas injection 40 shown by FIG. 9, except the first gas injection assembly 100, second gas injection assembly 102, and third gas injection assembly 104 are combined, in part, to form a single unit. The partial combination of the gas injection assemblies into a single unit improves the distribution of stage gas by the system 40. For example, the gas injection nozzles 110, 114 and 118 are combined together into a single unit. The gas injection assemblies 100, 102 and 104 are still proximate to each other and oriented in the same direction such that all three gas injection assemblies inject stage gas (steam and/or an alternative gas) into the flare tip 10 or combustion zone 70. The first gas injection assembly 100 is still configured to inject a first stage gas at a high flow rate and a high pressure into the flare tip 10 or combustion zone 70. The second and third gas injection assemblies 102 and 104 are still configured to inject a gas (steam and/or an alternative gas) at a lower flow rate and a high pressure into the flare tip 10 or combustion zone 70. The second gas injection nozzle 114 still includes at least one discharge port that has a total discharge area of no greater than one-half of the corresponding total discharge area of the discharge port(s) of the high flow rate, high pressure gas injection nozzle 110. The third gas injection nozzle 118 still includes at least one discharge port that has a total discharge area of no greater than one-half of the corresponding total discharge area of the discharge port(s) of the gas injection nozzle 114. For example, this embodiment of the staged gas injection system 40 can be substituted for the staged gas injection system 40 shown by FIG. 9.

As best shown by FIG. 11, the second gas injection nozzle 114 includes a plurality of discharge ports 114*a*, 114*b*, 114*c*, 114*d*, 114*e* and 114*f*). The gas injection nozzle 114 can include more than 6 or less than 6 discharge ports as desired. For example, from 6 to 24 discharge ports can be used. The second gas injection nozzle 114 is positioned around the first gas injection nozzle 110. The third gas injection nozzle 118 is positioned on the vertical center axis of the first gas injection nozzle 110. Although FIG. 11 shows the third gas injection nozzle 118 positioned above the first gas injection nozzle 110, the third gas injection nozzle can also be flush with or positioned below the first gas injection nozzle. As with the other embodiments of the staged gas injection system 40, the discharge of stage gas (steam and/or an alternative gas) aspirates air from the surrounding atmosphere which is mixed with the waste gas and helps promote smokeless combustion.

FIG. 12 illustrates use of the embodiment of the staged gas injection system 40 shown by FIGS. 10 and 11 in connection with the flare configurations shown by FIGS. 1A and 1B. The first gas injection nozzle 110, second gas injection nozzle 114, and third gas injection nozzle 118 each discharge stage gas (steam and/or an alternative gas) into the inner tubular member 14 to aspirate air from the surrounding atmosphere into the pre-mix zone 16 in the outer tubular member 12 of the flare tip 10. The aspirated air entrains into the waste gas conducted through the gas passage 22 before it exits the flare tip 10. The waste gas/air mixture then exits the flare tip 10. This again has the advantage of promoting smokeless combustion of the waste gas.

Although not shown by the drawings, additional features can also be included in the staged gas injection system 40 disclosed herein. For example, in applicable embodiments, the second gas injection assembly 60 can be thermally connected to the first gas injection assembly 50. This allows for the second gas injection assembly 60 to transfer heat into the first gas injection assembly 50 and help keep the temperature of the steam lines in the first gas injection assembly elevated to an acceptable level. For example, the temperature of the steam lines can be maintained at the saturation temperature of water at local barometric pressure, or higher.

In another embodiment, the staged gas injection system 40 includes one gas injection assembly. The gas injection assembly includes a stage gas source (steam source and/or alternative gas source) and a fluidly connected gas injection nozzle. The stage gas source provides stage gas (steam and/or alternative gas) to the gas injection nozzle. The gas injection nozzle is a variable area gas injection nozzle having the ability to vary the exit area of the stage gas as the stage gas pressure is increased, achieving the effect of low flow at high pressure and high flow at high pressure.

An advantage of using steam to entrain air into the waste gas is that it achieves smokeless combustion of the waste gas. An advantage of having a staged gas injection system that includes a gas injection assembly for injecting steam (and/or an alternative gas) at a low flow rate and a high pressure is that it allows the flare assembly to operate using less steam at turndown conditions. It allows for the necessary momentum to entrain air into the waste gas at turndown conditions while utilizing less steam. For example, a standard steam nozzle of an XP™ flare (sold by John Zink Hamworthy Combustion of Tulsa, Oklahoma) operating at 330 lb/hr of steam operates at less than 0.11 psig pressure and produces approximately 3 pounds force (lbf) of momentum. A low flow nozzle operating at approximately 5 psig would also produce approximately 3 lbf of momentum but would require less than 70 lb/hr of steam to do so.

The flare tip provided by the present disclosure includes a flare tip that includes the staged gas injection system 40 described above. The flare tip can include any of the configurations of the flare tip 10 described above. Any of the embodiments of the staged gas injection system 40 described above can be used in association with the flare tip. As will be understood, the stage gas for the various stages can be the same gas or different. For example, the first stage gas, second stage gas and third stage gas (if used) can all be steam; or the first stage gas can be steam and the second can be an alternative gas (such as nitrogen or air); or the first stage gas can be an alternative gas (such as nitrogen or air) and the second stage gas can be steam; or the first stage can be steam and an alternative gas, and the second stage can be an alternative gas; or the first stage can be air, the second stage can be nitrogen, and the third can be steam. Other combinations can also be utilized.

Example

The staged gas injection system shown by FIG. 4B herein was tested. As shown, the flare tip 10 included both standard high flow high pressure (HFHP) steam nozzles and low flow high pressure (LFHP) steam nozzles. In carrying out the tests, steam was injected through both the HFHP nozzles and the LFHP nozzles.

The first phase of the test consisted of various flow rates of steam being sent to the HFHP nozzles while the steam flow to the LFHP nozzles was turned off. For each flow rate of HFHP steam, the hydrocarbon flow rate to the flare tip was adjusted to the maximum that still produced smokeless combustion.

The second phase of the test consisted of various flow rates of steam being sent to the LFHP nozzles while the steam flow to the HFHP nozzles was turned off. For each flow rate of LFHP steam, the hydrocarbon flow rate to the flare was adjusted to the maximum that still produced smokeless combustion.

FIG. 13 illustrates the results of the tests. In summary, the tests showed that the amount of steam needed for smokeless combustion at turndown conditions can be reduced by using LFHP steam nozzles.

Figure 14:
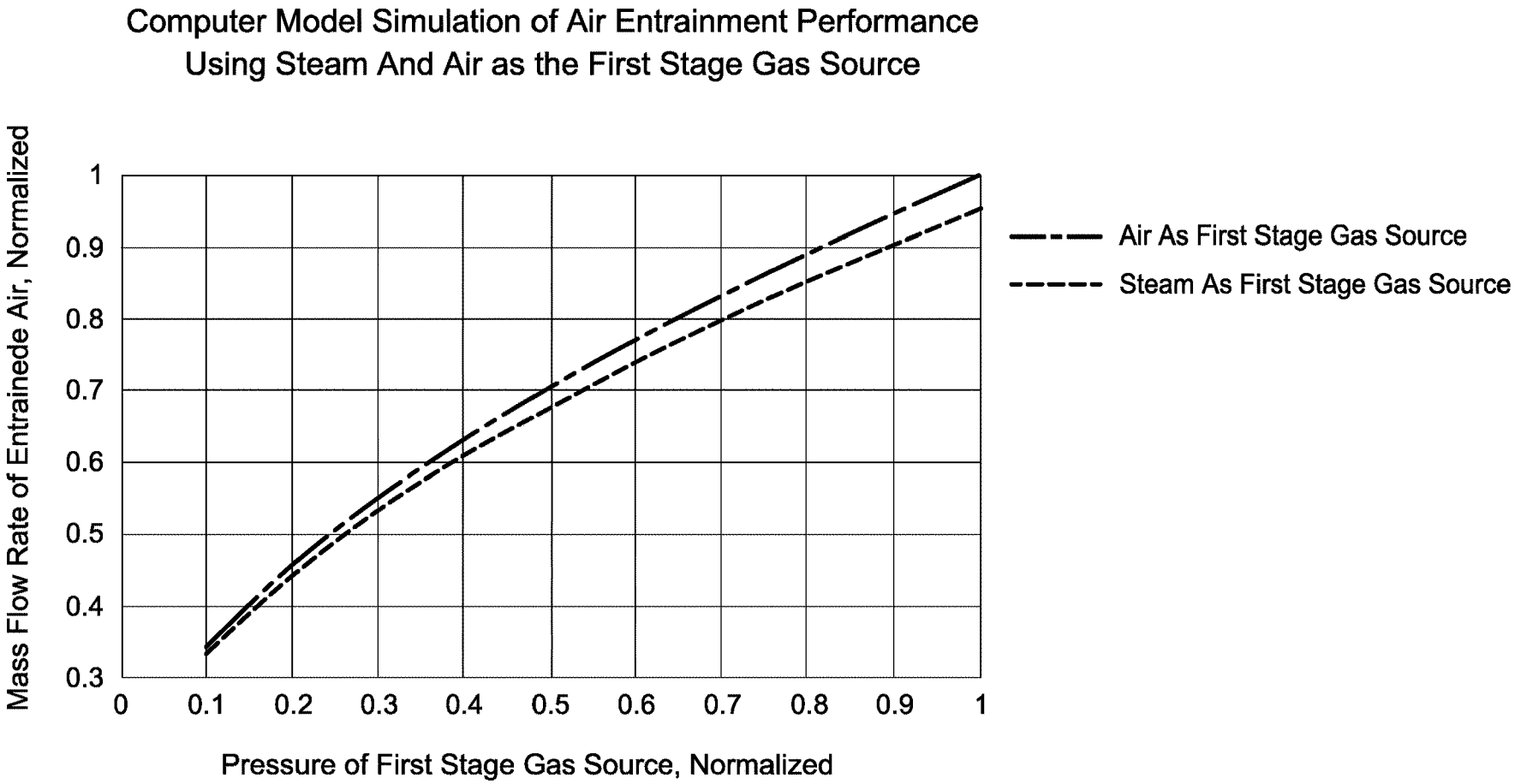
FIG. 14 is a graph comparing the air entrainment performance using both steam and air as the first stage gas source.

Additionally, a computer model simulation (based on experimental test data) was performed comparing the air entrainment performance using both steam and air as the first stage gas source. FIG. 14 illustrates the results of the simulation. The results show that for a given first stage gas source pressure, the air entrainment performance for both air and gas is nearly identical. Thus, illustrating that the first stage gas can be steam or an alternative gas.

Therefore, the present disclosure is well adapted to attain the ends and advantages mentioned, as well as those that are inherent therein. The particular embodiments disclosed above are illustrative only, as the present disclosure may be modified and practiced in different, but equivalent, manners apparent to those skilled in the art having the benefit of the teachings herein. Furthermore, no limitations are intended to the details of construction or design herein shown, other than as described in the claims below. It is therefore evident that the particular illustrative examples disclosed above may be altered or modified, and all such variations are considered within the scope and spirit of the present disclosure. While apparatus and methods may be described in terms of "comprising," "containing," "having," or "including" various components or steps, the apparatus and methods can also, in some examples, "consist essentially of" or "consist of" the various components and steps. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the specification.

What is claimed is:

1. A staged gas injection system for a flare tip that can discharge waste gas into a combustion zone downstream from the flare tip, the staged gas injection system comprising:

a flare tip that includes an inner tubular member disposed within an outer tubular member so as to form a pre-mix zone downstream from the inner tubular member and within the outer tubular member, a stage gas source;

a first gas injection assembly, said first gas injection assembly being configured to inject a stage gas at a high flow rate and a high pressure from a first discharge port into the inner tubular member of the flare tip and including:

a first gas injection nozzle fluidly connected to said stage gas source from which said stage gas is received by the first gas injection nozzle; and a second gas injection assembly, said second gas injection assembly configured to inject said stage gas at a low flow rate and a high pressure from a second discharge port into the inner tubular member of the flare tip and including:

a second gas injection nozzle fluidly connected to said stage gas source from which said stage gas is received by the second gas injection nozzle, wherein said first gas injection assembly and said second gas injection assembly are spaced apart from each other and oriented in the same direction, a first central axis extending through the first discharge port offset from and extending parallel to a second central axis extending through the second discharge port, wherein said first discharge port and said second discharge port eject gas parallel to one another such that both said first discharge port and said second discharge port discretely inject gas into a first end of the inner tubular member of the flare tip, and wherein the low flow rate means the first gas injection assembly and second gas injection assembly are configured such that, on a per nozzle basis, the low flow rate is one-half or less than the high flow rate.

2. The staged gas injection system of claim 1, wherein said stage gas source comprises a first stage gas source which provides a first stage gas to said first gas injection assembly, and a second stage gas source which provides a second stage gas to said second gas injection assembly, such that said first gas injection assembly injects first stage gas into the inner tubular member of the flare tip and the second gas injection assembly injects second stage gas into the inner tubular member of the flare tip.

3. The staged gas injections system of claim 2, wherein the first stage gas comprises steam and the second stage gas comprises an alternative gas.

4. The staged gas injection system of claim 2, wherein the first stage gas comprises an alternative gas and the second stage gas comprises steam.

5. The staged gas injection system of claim 1, wherein said stage gas is steam.

6. The staged gas injection system of claim 1, wherein said stage gas is an alternative gas.

7. The staged gas injection system of claim 1 further comprising:

a third gas injection assembly, said third gas injection assembly including a third gas injection nozzle configured to inject gas at a low flow rate and a high pressure into the inner tubular member of the flare tip, and wherein said third gas injection assembly is spaced apart from the first and second oriented in the same direction as said first gas injection assembly, second gas injection assembly and third gas injection assembly inject gas into the first end of the inner tubular member of the flare tip.

8. The staged gas injection system of claim 7, wherein:

the stage gas source includes:

a first stage gas source, said first stage gas source being a source of first stage gas;

the first gas injection nozzle fluidly connected to said first stage gas source such that said first stage gas is injected at a high flow rate and a high pressure by the first gas injection assembly into the inner tubular member of the flare tip;

a second stage gas source, said second stage gas source being a source of second stage gas;

the second gas injection nozzle fluidly connected to said second stage gas source such that said second stage gas is injected at a low flow rate and a high pressure by the second gas injection assembly into the inner tubular member of the flare tip;

a third stage gas source, said third stage gas source being a source of third stage gas;

the third gas injection nozzle fluidly connected to said third stage gas source such that the third stage gas is injected at a low flow rate and a high pressure by the third gas injection assembly into the inner tubular member of the flare tip.

9. The staged gas injection system of claim 8, wherein said first stage gas, said second stage gas, and said third stage gas are each an alternative gas.

10. The staged gas injection system of claim 8, wherein said first stage gas is steam, and said second stage gas and said third stage gas are each steam.

11. The staged gas injection system of claim 7, wherein the low flow rate for the second gas injection assembly means the first gas injection assembly and second gas injection assembly are configured such that, on a per nozzle basis, the low flow rate of the second gas injection assembly is one-half or less than the high flow rate, and the low flow rate for the third gas injection assembly means the second gas injection assembly and third gas injection assembly are configured such that, on a per nozzle basis, the low flow rate of the third gas injection assembly is one-half or less than the low flow rate of the second gas injection assembly.

12. A staged gas injection system for a flare tip that can discharge waste gas into a combustion zone downstream from the flare tip, comprising:

a stage gas source;

a first gas injection assembly, said first gas injection assembly being configured to inject a stage gas at a high flow rate and a high pressure into the combustion zone via a first discharge port and including a first gas injection nozzle fluidly connected to said stage gas source from which said stage gas is received by the first gas injection nozzle; and a second gas injection assembly, said second gas injection assembly configured to inject said stage gas at a low flow rate and a high pressure into the combustion zone via a second discharge port and including a second gas injection nozzle fluidly connected to said stage gas source from which said stage gas is received by the second gas injection nozzle, wherein said first gas injection assembly and said second gas injection assembly are spaced apart from each other and oriented in the same direction, a first central axis extending through the first discharge port offset from and extending parallel to a second central axis extending through the second discharge port, wherein said first discharge port and said second discharge port eject gas parallel to one another such that both said first discharge port and said second discharge port discretely inject gas into an inner tubular member such that the gases from the first gas injection nozzle and the second gas injection nozzle are mixed prior to injection into the combustion zone, and wherein the low flow rate means the first gas injection assembly and second gas injection assembly are configured such that, on a per nozzle basis, the low flow rate is one-half or less than the high flow rate.

13. The staged gas injection system of claim 12, wherein said stage gas source comprises a first stage gas source which provides a first stage gas to said first gas injection assembly, and a second stage gas source which provides a second stage gas to said second gas injection assembly, such that said first gas injection assembly injects first stage gas into the combustion zone and said second gas injection assembly injects second stage gas into the combustion zone.

14. The staged gas injections system of claim 13, wherein the first stage gas comprises steam and the second stage gas comprises an alternative gas.

15. The staged gas injection system of claim 13, wherein the first stage gas comprises an alternative gas and the second stage gas comprises steam.

16. The staged gas injection system of claim 12, wherein said stage gas is steam.

17. The staged gas injection system of claim 12, wherein said stage gas is an alternative gas.

18. A staged gas injection system for a flare tip that can discharge waste gas into a combustion zone, comprising:

a first gas injection assembly, said first gas injection assembly being configured to inject gas at a high flow rate and a high pressure into the combustion zone via a first discharge port, and a second gas injection assembly, said second gas injection assembly configured to inject gas at a low flow rate and a high pressure into the combustion zone via a second discharge port, a third gas injection assembly, said third gas injection assembly configured to inject gas at a low flow rate and a high pressure into the combustion zone via a third discharge port, and wherein said first gas injection assembly, said second gas injection assembly and said third gas injection assembly are spaced apart from each other and oriented in the same direction, a first central axis extending through the first discharge port offset from and extending parallel to a second central axis extending through the second discharge port, wherein said first discharge port and said second discharge port eject gas parallel to one another such that said first discharge port, second discharge port and third discharge port discretely inject gas into an inner tubular member such that the gases from the first gas injection assembly, the second gas injection assembly, and third gas injection assembly are mixed prior to injection into the combustion zone.

19. The staged gas injection system of claim 18, wherein:

the first gas injection assembly includes:

a first stage gas source, said first stage gas source being a source of first stage gas;

a first gas injection nozzle fluidly connected to said first stage gas source such that said first stage gas is injected at a high flow rate and a high pressure by the first gas injection assembly into the inner tubular member from the first discharge port;

the second gas injection assembly includes:

a second stage gas source, said second stage gas source being a source of second stage gas;

a second gas injection nozzle fluidly connected to said second stage gas source such that said second stage gas is injected at a low flow rate and a high pressure by the second gas injection assembly into the inner tubular member from the second discharge port;

the third gas injection assembly includes:

a third stage gas source, said third stage gas source being a source of third stage gas;

a third gas injection nozzle fluidly connected to said third stage gas source such that the third stage gas is injected at a low flow rate and a high pressure by the third gas injection assembly into the inner tubular member from the third discharge port.

20. The staged gas injection system of claim 19, wherein said first stage gas, said second stage gas, and said third stage gas are each steam.

21. The staged gas injection system of claim 19, wherein said first stage gas is an alternative gas, and said second stage gas and said third stage gas are each an alternative gas.

22. The staged gas injection system of claim 18, wherein the low flow rate for the second gas injection assembly means the first gas injection assembly and second gas injection assembly are configured such that, on a per nozzle basis, the low flow rate of the second gas injection assembly is one-half or less than the high flow rate, and the low flow rate for the third gas injection assembly means the second gas injection assembly and third gas injection assembly are configured such that, on a per nozzle basis, the low flow rate of the third gas injection assembly is one-half or less than the low flow rate of the second gas injection assembly.

* * * * *